US011814148B2

(12) United States Patent
Humphries et al.

(10) Patent No.: US 11,814,148 B2
(45) Date of Patent: Nov. 14, 2023

(54) MARITIME FLOATATION DEVICE

(71) Applicant: MAS ZENGRANGE (NZ) LIMITED, Lower Hutt (NZ)

(72) Inventors: Tony Humphries, Lower Hutt (NZ); Adam Holdaway, Lower Hutt (NZ); David Hamilton, Lower Hutt (NZ); Gregory Marsden, Lower Hutt (NZ); Mick Jones, Lower Hutt (NZ); Grant Taylor, Lower Hutt (NZ)

( * ) Notice: Subject to any disclaimer, the term of this patent is extended or adjusted under 35 U.S.C. 154(b) by 854 days.

(21) Appl. No.: 15/773,164

(22) PCT Filed: Dec. 2, 2015

(86) PCT No.: PCT/NZ2015/050202

§ 371 (c)(1),
(2) Date: Jan. 14, 2021

(87) PCT Pub. No.: WO2017/095234

PCT Pub. Date: Jun. 8, 2017

(65) Prior Publication Data

US 2021/0070409 A1 Mar. 11, 2021

(51) Int. Cl.
*B63G 7/02* (2006.01)
*B63B 3/09* (2006.01)
(Continued)

(52) U.S. Cl.
CPC ..... *B63G 7/02* (2013.01); *B63B 3/09* (2013.01); *B63B 5/24* (2013.01); *B63B 21/50* (2013.01); *B63B 59/04* (2013.01); *F42D 5/04* (2013.01)

(58) Field of Classification Search
CPC ... B63G 7/02; B63G 7/04; B63G 7/06; B63G 7/08; F42D 5/04
See application file for complete search history.

(56) References Cited

U.S. PATENT DOCUMENTS 3,125,953 A * 3/1964 Foerster ..... F42B 22/04 367/133
3,880,103 A * 4/1975 Talkington ..... B63G 7/02 405/185

(Continued)

*Primary Examiner* — Joshua E Freeman
(74) *Attorney, Agent, or Firm* — INVENTA CAPiTAL PLC

(57) ABSTRACT

A maritime floatation device for using remote firing devices above and below the water line by way of non-electric or electric initiation, the maritime floatation device includes:

a) a receiver housing having a combination of at least two receivers connectable via shock tube to respective explosive means, one receiver is adapted for timed initiation for separation and the second receiver adapted for remote initiation or timed initiation in order to meet the desired required operational capabilities of the maritime floatation device;

b) a releasable basket housing connected to receiver housing;

c) retention means for retaining two housings together;

d) separation means for deactivating the retention means so as to allow for separation the receiver housing from the basket housing upon the activation of the separation means by the explosive means initiated from a timed initiated receiver;

e) a shock tube spool position able within the basket housing wherein the spool accommodates and includes a length of shock tube that is connectable to the second receiver and to explosive means so as to allow flexibility in deployment of the maritime floatation device to suit the desired standard operating procedures; and/or f) floats attachable to the receiver housing so as to allow receiver housing to float to the surface once the receiver housing is separated from the basket housing;

wherein the maritime floatation device allows non-electric or electric initiation of shock-tube with properties able to (Continued)

be deployed and operated under water at water depths without ingress of water impacting on the reliability of the maritime floatation device.

20 Claims, 14 Drawing Sheets

(51) Int. Cl.

| | |
|---|---|
| ***B63B 5/24*** | (2006.01) |
| ***B63B 21/50*** | (2006.01) |
| ***B63B 59/04*** | (2006.01) |
| ***F42D 5/04*** | (2006.01) |

(56) References Cited

U.S. PATENT DOCUMENTS 3,946,696 A * 3/1976 Lubnow ..... B63G 7/06 114/221 R
4,020,780 A * 5/1977 Shumaker ..... B63G 7/04 89/1.13
4,037,555 A * 7/1977 Berman ..... B63B 22/003 114/253
5,042,387 A * 8/1991 Backstein ..... B63G 7/02 89/1.13
8,297,162 B2 * 10/2012 Fournier ..... B63G 7/02 89/1.13
2008/0041264 A1 * 2/2008 Fournier ..... B63G 7/02 901/46
2008/0276818 A1 * 11/2008 Ballantine ..... C06C 5/04 102/202.1
2013/0199258 A1 * 8/2013 Naitou ..... B21D 22/22 72/352
2013/0199358 A1 * 8/2013 Perrin ..... B63G 7/02 86/50
2013/0263725 A1 * 10/2013 Isserstedt ..... B63G 7/06 89/1.13
2015/0211833 A1 * 7/2015 Humphries ..... F42D 1/045 102/215
2021/0070409 A1 * 3/2021 Humphries ..... B63G 7/02

* cited by examiner

MARITIME FLOATATION DEVICE

The invention relates to a maritime floatation device that is used to enhance existing remote firing device capabilities for the initiation of electric and non-electric detonators under or above the water line utilising remote or timed initiation.

BACKGROUND OF INVENTION

User groups performing under or above water line remote firing tasks are presently faced with a number of limitations or trade-offs using present maritime floatation solutions.

Early methods of operation for maritime remote firing capability was to wrap detonating cord around a roll of bubble wrap, attach a non-electric detonator with safety fuse cut to the appropriate timed length and initiated with a self-cocking firing device (SCFD). The diver took the charge end of the detonating cord and dived to the target with the roll unraveling itself on the surface. On completion of charge placement and the diver withdrawing out of the water, the firing system (safety fuse and SCFD) was connected and initiated on the surface. The users then left the area to a safe distance and waited for the charge to initiate on time delay. Problems with this method were that there was no command and control once the SCFD was fired and the initiation chain started. It was an effective way of initiation but the method was dated and not appropriate for operations, generally only for training and limited at that.

The first major hurdle to overcome is the integration of equivalent land based remote firing operations into the maritime environment. Maritime based tasks increase complexity of deployment due to many factors; such as diver limitations, such as operation duration due to limited air supply, environmental and weather challenges.

The second major hurdle is cost. Available solutions can meet user requirements extending their capability but at a high cost and low cost solutions do not meet all user requirements. Some users will have to make do with what they have where improvisation is used to meet requirements. This in itself employs many issues including safety.

Summary of Disadvantages of Existing Solutions:

Expensive—cost per use.

Time consuming—deployment and setup.

Manpower intensive—deployment and setup.

Not covert.

Depth limitations.

Variations in improvisation.

Safety implications.

Acoustic issues.

Where an Unmanned Underwater Vehicle (UUV) is used, these generally deploy in combat mode utilising a hydrostatic fuse arming the system when 10 m depth is achieved. It has an integral main charge and the general deployment method is to swim it to target, allow it to arm so it can blow itself up along with the mine. A countermine charge is of high value per initiation. As UUV combat rounds require 10 m depth to arm the fuse, this makes them ineffective in Very Shallow Water (VSW).

Where a diver is used, the diver may use a commercially available surface float or create an improvised surface float. Improvised floats are sometimes as big a wooden pallets with buoys or large empty containers lashed to them. There are several users that still use safety fuse where this is lit on the surface (pallet) to initiate a flash detonator that in turn initiates the detonating cord that runs to the target for the main charge initiation. There are presently no identified floats that meet the maritime requirements for separation post deployment.

Shock tube can be used as a direct line to a charge at the target. These are sometime initiated with a hand held firing device such as s mini-flare gun that incorporates a shot gun primer cartridge position. This solution requires user interaction with the hand held initiator and limits the distance the user can be away from the target.

Alternative solutions use acoustic remote firing devices. These are problematic for divers as they are not always reliable and affected by coral, swarms of fish, metal objects and varieties of water types.

The Applicants previous solutions focused on a floatation device that can only be suitable for surface initiation. The previous solutions were able to be deployed subsurface (<30 m depth) or just on the surface due to design limitations. Floatation was achieved by using floating devices made of foam or filled with air. These solutions can only hold a single remote firing device that initiates a detonator connected to detonating cord held in a separate floating sacrificial tube. The set-up method used for the previous solutions is time consuming and utilising detonating cord from surface to target does not provide a covert option.

Time delay initiation sub-surface was technically possible but provided additional risks due to the materials used. A secondary hazard to the divers would have been caused from material fragmentation and depending on the main charge size or target size in the case of a mine, could have significantly increased the danger area making the task a longer and more difficult affair.

The previous solutions were generally used for electric initiation with a connection to a sealed external sacrificial assembly that was not part of the main housing. Although used within service limitations with setup and operational capabilities limited its use.

A solution is required to enhance the operational capability of a land based RFD for operation within the increasing threats of the maritime environment and demand by associated maritime user groups. This provides a single solution to all maritime user groups meeting a spectrum of operational capabilities.

A solution is required to extend the safety aspect and reliability of initiating detonators/detonating explosives. Safety in this context means to ensure the unintentional initiation of detonators during the setup/deployment of the solution during operation. Unintentional initiation has a severity of being catastrophic.

Any solution must provide the ability for the user to conduct operations in very shallow water to deep water scenarios.

There is a need to conduct surface initiations over short and long distance remotely and sub-surface initiation using timed delay. Any solution shall be able to be set-up and deployed for surface deployment so that it can be remotely initiated over distance. Any solution also shall be able to be set-up and deployed for sub-surface deployment and able to self-release to the surface.

Using the maritime floatation device and a variety of receivers provide the user with multiple operational capabilities able to support:

SUMMARY OF INVENTION

In a first aspect the invention resides in a maritime floatation device for using remote firing devices above and below the water line by way of non-electric or electric initiation, the maritime floatation device includes:

a) a receiver housing having a combination of at least two receivers connectable via shock tube to respective explosive means, one receiver is adapted for timed initiation for separation and the second receiver adapted for remote initiation or timed initiation in order to meet the desired required operational capabilities of the maritime floatation device;

b) a releasable basket housing connected to receiver housing;

c) retention means for retaining two housings together;

d) separation means for deactivating the retention means so as to allow for separation the receiver housing from the basket housing upon the activation of the separation means by the explosive means initiated from a timed initiated receiver;

e) a shock tube spool position able within the basket housing wherein the spool accommodates and includes a length of shock tube that is connectable to the second receiver and to explosive means so as to allow flexibility in deployment of the maritime floatation device to suit the desired standard operating procedures; and/or f) floats attachable to the receiver housing so as to allow receiver housing to float to the surface once the receiver housing is separated from the basket housing;

wherein the maritime floatation device allows non-electric or electric initiation of shock-tube with properties able to be deployed and operated under water at water depths without ingress of water impacting on the reliability of the maritime floatation device.

Preferably, the receiver housing is made from materials that minimize corrosion and magnetic signature.

Preferably, the materials a combination of Acetal, stainless steel and polycarbonate parts.

Preferably, the basket housing is capable of holding a length of up to 500 m of shock tube spool so that the maritime floatation device is operable to depths within surface and 400 m and to provide stretch and slack between the two housings once the two housings of the maritime floatation device have been separated.

Preferably, the receiver housing has pivotally mounted downwardly depending ejector arms which cooperatively engage with jaw receiving means mounted on the basket housing, the ejector arms are retained in a clamping action with the jaw receiving means by the retention means so as to releasably secure the receiver and basket housings together.

Preferably, the jaw receiving means are retaining lugs, the retaining lugs include an angled surface so as to assist in the releasing and opening of the ejector arms upon deactivation of the retention means by the separation means to allow the two housings to separate from one another.

Preferably, the receiver housing has a lid with a RRx activation push button to allow for button activation of the receivers within the receiver housing.

Preferably, the lid has an aperture adapted to accommodate an antenna or a water tight cap if no antenna is required.

Preferably, the lid is secured to the housing by a locking cord, the locking cord is fitted through a locking channel in the housing.

Preferably, the receiver housing has two display windows and two receiver buttons so as to allow visual inspection of the receiver displays and external access to operate the internally fitted receivers within the housing.

Preferably the receiver housing has at least two spaced apart downwardly depending integrated legs with captive stainless steel launch springs, the legs are in alignment and contact with the top of the basket housing when the receiver housing is connected to the housing basket, the captive springs are compressed and under load when the receiver housing is connected to the basket housing and are adapted to provide a launch force for separation of the receiver housing form the basket housing upon activation of the separation means.

Preferably, there are four equally spaced apart downwardly depending integrated legs.

Preferably, the separation means includes a blade assembly having a cutting blade adapted to pass through the receiver housing so as to deactivate the retention means, the blade assembly is housed within the receiver housing and is connected to a separation initiation chamber within the receiver housing, the separation initiation chamber includes therein the explosive means (in one case connected via shock tube) to the timed initiated receiver such that upon activation of the timed initiated receiver the explosive means detonates to cause the cutting blade to deactivate the retention means thus causing the ejector arms to be released and the captive springs on the legs to be decompressed forcing the receiver housing to separate from the basket housing.

Preferably, the retention means that releasable retains the two housing together includes an elongate member securable to the ejector arms to hold the ejector arms in a clamping position to the lugs on the basket housing, the elongate member is adapted to be severed by the cutting blade in order to assist in releasing the ejector arms form the lugs.

Preferably, the elongate member is a tie, cord, wire, string, link, strand, line, band, cable or twine that is adapted to be severable.

Preferably, the elongate member is tensioned so as to cause the ejector arms to be securely clamped to the lugs.

Preferably, the elongate member is a spring loaded lanyard.

Preferably, the receiver housing has a gland plate and a gland on the underside of the receiver housing, the gland plate and gland are adapted to allow the connection of shock tube from the spool to enter into the receiver housing, the gland plate houses the gland in order to provide strain relief and a water tight seal between the shock tube internal to the receiver housing and shock tube external to the receiver housing.

Preferably, the receiver housing includes void(s) for general securing and tethering of the maritime floatation device.

Preferably, the basket housing includes a lid secured to the basket housing by locking cord inserted into a locking channel on the basket housing, the lid includes the retaining lugs.

Preferably, the base of the basket housing includes a shackle for use in anchoring or tethering the basket housing to the sea floor or any other underwater feature or device suitable for anchoring or tethering purposes.

Preferably, the base of the basket housing includes a plurality of shock tube retention holes that allow locking of the shock tube in order to provide strain relief.

Preferably, the explosive means of the main charge is a detonator connectable and initiated via a shock tube.

Preferably, the shock tube is connectable and initiated via either direct from the second receiver able to initiate shock tube or from the second receiver able to initiate electric detonators.

Preferably, the basket housing allows includes a capability to allow connection from electric to shock tube.

Preferably, the connection capability from electric to shock tube is capable of water depths within surface and 400 m and prevents water ingress post detonator initiation.

Preferably, the electric to shock tube connection includes a mechanical fixing means to allow reliable initiation of shock tube by electric initiation, the mechanical fixing means fixes the placement and location of shock tube through a retention system so as to retain the shock tube in the vicinity of the electric detonator for reliable initiation under water.

Preferably, the shock tube spool includes a two piece reeling assembly and a clamping means to allow for securing during operation of the spool.

Preferably, the floats are rings that provide buoyancy and enhanced stability for the maritime floatation device.

Preferably, multiple float rings can be used together or independently.

Preferably, the floats are made from buoyant foam.

Preferably, the multiple basket housings are able to be joined and stacked on top of each other.

Preferably, the multiple basket housings are able to be joined to customised solutions for anchoring or tethering options.

Preferably, the maritime floatation device is able to be tethered using permanent magnets or switchable magnets.

In a second aspect the invention resides in a set up method of maritime floatation device as described in the first aspect. The method includes the steps when using two shock tube receivers:

a) undertaking a pre inspection drill of the maritime floatation device is undertaking, if the maritime floatation device fails the pre inspection drill it is quarantined;
b) preparing at least two receivers;
c) removing the lid of the receiver housing and selecting top and bottom brackets for receivers and securing the base bracket inside receiver housing;
d) preparing a length of shock tube of >100 mm and insert the shock tube in to the separation initiation chamber or electric initiating means within the separation initiation chamber:
e) switching on the timed initiated receiver that is used for the float separation;
f) inserting the remote initiated receiver in to the receiver housing;
g) clamping and securing the receivers firmly into place using the top bracket;
h) inserting the separation shock tube length in to the timed initiated receiver after BIT test and timer setup are completed or connecting an electric initiating method of separation to a timed initiated receiver after BIT test is completed;
i) inserting the spool into the basket housing;
j) taking the end of the shock tube with the pre-fitted detonator and passing through the three shock tube retention holes in the base of the basket housing;
k) adjusting the length of shock tube between the basket housing and detonator;
l) passing the shock tube through centre hole of basket lid;
m) assembling and securing the lid to the basket housing using the locking cord and making sure the shock tube is pulled through the centre hole in the lid;
n) ensuring the receiver housing gland locking wheel is open;
o) taking the spare end of shock tube trim the running end of shock tube to ensure a dry and square cut as per shock tube manufacturer recommendations prior to insertion into the explosive means of the remote initiated receiver or receivers;
p) taking the freshly cut end of shock tube fed from the centre of the basket lid internal to the spool and feed into the receiver housing through the gland locking wheel and the gland plate or feeding the spare end of the shock tube into the electric to shock tube initiation capability;
q) turning on the remote initiated receiver by pushing the external push button;
r) insert the shock tube in to the receiver after BIT test is completed;
s) orientating and adding the float(s) on the receiver housing;
t) checking an o-ring used for creating a seal for the housing lid;
u) orientating the lid to fit to the receiver housing using locking cord;
v) closing the gland locking wheel on the receiver housing base to provide a watertight seal;
w) assembling the retaining lanyard to the receiver housing such that the ejector arms should move freely but retain tension keeping the ejector arms in the closed clamping position;
x) feeding any excess shock tube on to the spool;
y) orientating and positioning the captive sprung legs with respective holes in the basket housing lid; and
z) pushing down the receiver housing onto the basket housing so as to secure the receiver housing to the basket housing such that maritime floatation device is ready for deployment.

In a third aspect the invention resides in a set up method of maritime floatation device as described in the first aspect. The method includes the steps of using one shock tube receiver and one electric receiver.

In a fourth aspect the invention resides in a set up method of maritime floatation device as described in the first aspect. The method includes the step of using one shock tube receiver.

In a fifth aspect the invention resides in a set up method of maritime floatation device as described in the first aspect. The method includes the step of using two electric receivers.

In a sixth aspect the invention resides in a set up method of maritime floatation device as described in the first aspect. The method includes the step of using one electric receiver.

Any other aspect as herein described.

BRIEF DESCRIPTION

The invention will now be described, by way of example only, by reference to the accompanying drawings:

FIG. 1 is a diagrammatic view showing a first deployment option for the maritime floating device in accordance to an embodiment of the invention.

FIG. 2 is a diagrammatic view showing a second deployment option for the maritime floating device in accordance to an embodiment of the invention.

FIG. 3 is a diagrammatic view showing a third deployment option for the maritime floating device in accordance to an embodiment of the invention.

FIG. 4 is a diagrammatic view showing a fourth deployment option for the maritime floating device in accordance to an embodiment of the invention.

FIG. 5 is an exploded perspective view of the floatation device showing the main receiver housing and basket assembly and components in accordance to an embodiment of the invention.

FIG. 6 is a perspective view of the floatation device with receiver housing setup for connecting to its base as shown in FIG. 5.

FIG. 7 is an isometric top view of the floatation device basket housing as shown in FIGS. 5 and 6.

FIG. 7A is a bottom, side and top view of the basket as shown in FIGS. 5, 6 and 7.

FIG. 8 is an isometric side view of the floatation device accessory, the sacrificial tube and component in accordance to an embodiment of the invention.

FIG. 9 is an isometric side view of the floatation device spooler in accordance to an embodiment of the invention.

FIG. 10 is a front and top view of the floatation device float ring, attached and unattached respectively in accordance to an embodiment of the invention.

FIG. 11 is a flow chart showing the top level steps for the floatation device set-up in accordance with a first preferred embodiment of the invention.

FIG. 12 is a flow chart showing the top level steps for the floatation device set-up in accordance with a first preferred embodiment of the invention.

FIG. 13 is a flow chart showing the top level steps for the floatation device set-up in accordance with a first preferred embodiment of the invention.

FIG. 14 is a flow chart showing the top level steps for the floatation device set-up in accordance with a first preferred embodiment of the invention.

FIG. 15 is a flow chart showing the top level steps for the floatation device set-up in accordance with a first preferred embodiment of the invention.

DESCRIPTION OF DRAWINGS

The following description will describe the invention in relation to preferred embodiments of the invention, namely a separable underwater/overwater floatation device. The invention is in no way limited to these preferred embodiments as they are purely to exemplify the invention only and that possible variations and modifications would be readily apparent without departing from the scope of the invention.

The maritime floatation device has four deployment options as is shown in FIGS. 1 to 4. These being:

Figure 1:
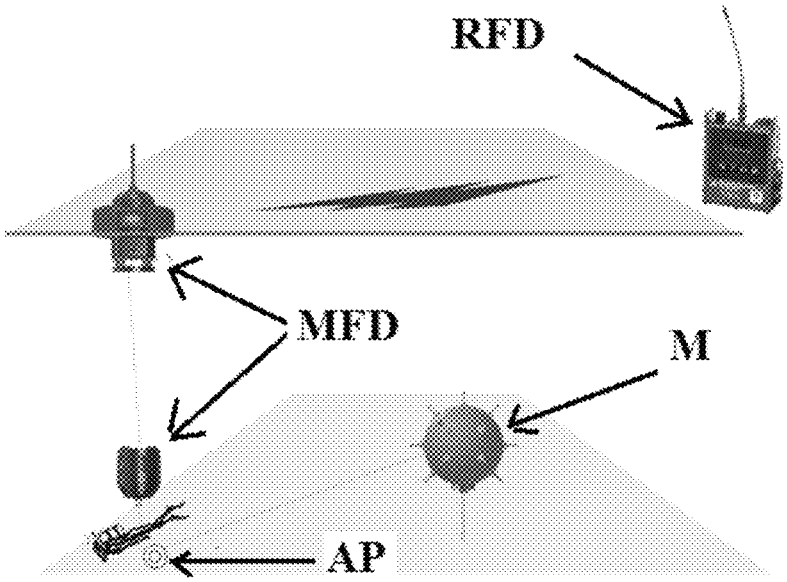
Figure 2:
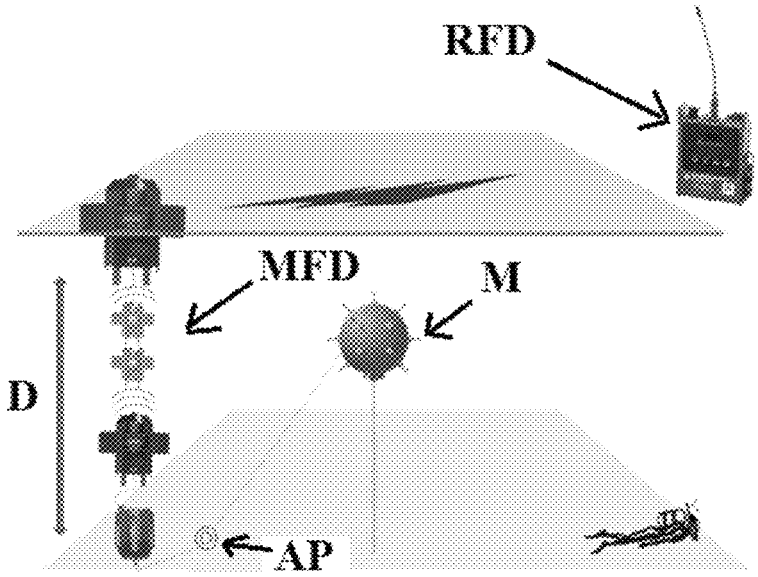
Figure 3:
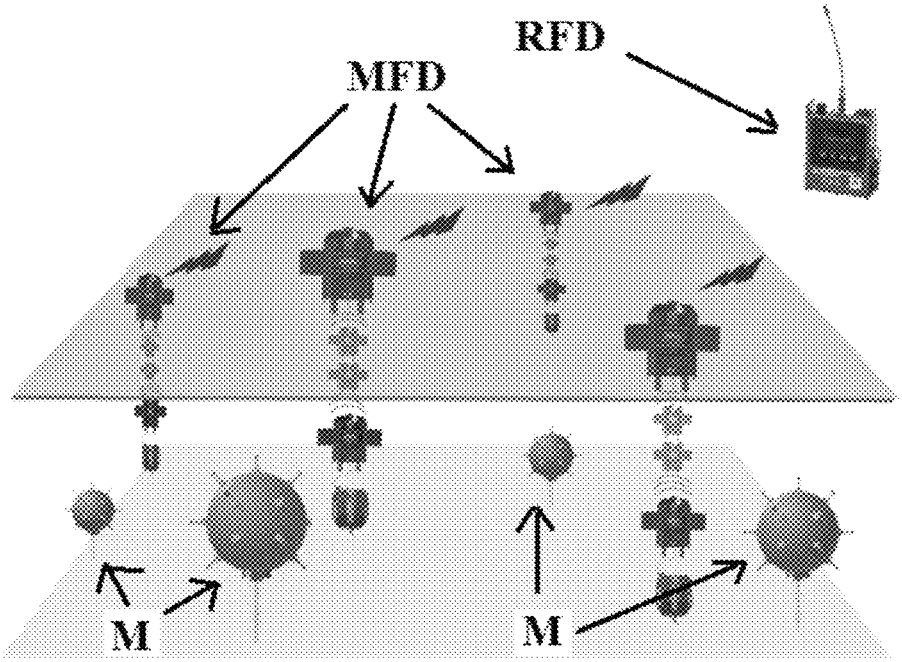
Figure 4:
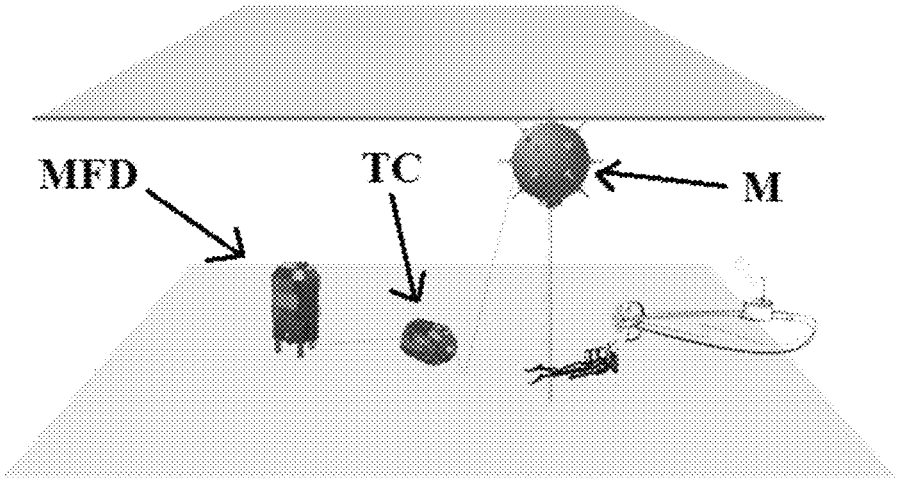

a. Surface Radio Frequency Remote Initiated Firing (RIF), —FIG. 1. In this scenario a mine is to blown up using the invented maritime floatation device MFD. A diver secures the maritime floatation device to an anchor point. After a timed interval the two housings of the maritime floatation device MFD separate in which the receiver housing floats to the surface ready for remote initiated firing by a remote firing device RFD.

b. Sub-Surface Diver release and Surface Initiation using RIF, —FIG. 2. In this scenario sub-surface deployment and placement and manual release of the MFD for surface initiation.

c. Sub-Surface deployment using Timed Initiated Firing (TIF), —FIG. 3. In this scenario subsurface initiation using the timer countdown (TIF) under water to initiate the main charge.

d. Sub-Surface deployment for TIF separation surface RIF Initiation, —FIG. 4. In this scenario subsurface to Surface deployment—Deployed under water with Float MFD separation achieved by using timer countdown TC. Upon the Float reaching the surface, initiation can take place from distance.

The floatation device provides the ability to use remote firing devices above and below the water line utilising the timed and remote initiation features of the receiver(s). The floatation device consists of two main parts;

a. The top half known as the receiver housing, this is able to house a combination of receivers to meet the required operational capabilities.

b. The bottom half known as the Basket, this is used to accommodate a length of spooled Shock Tube (ST) to give the user flexibility in deployment to suit their Standard operating Procedures (SOP's).

Figure 5:
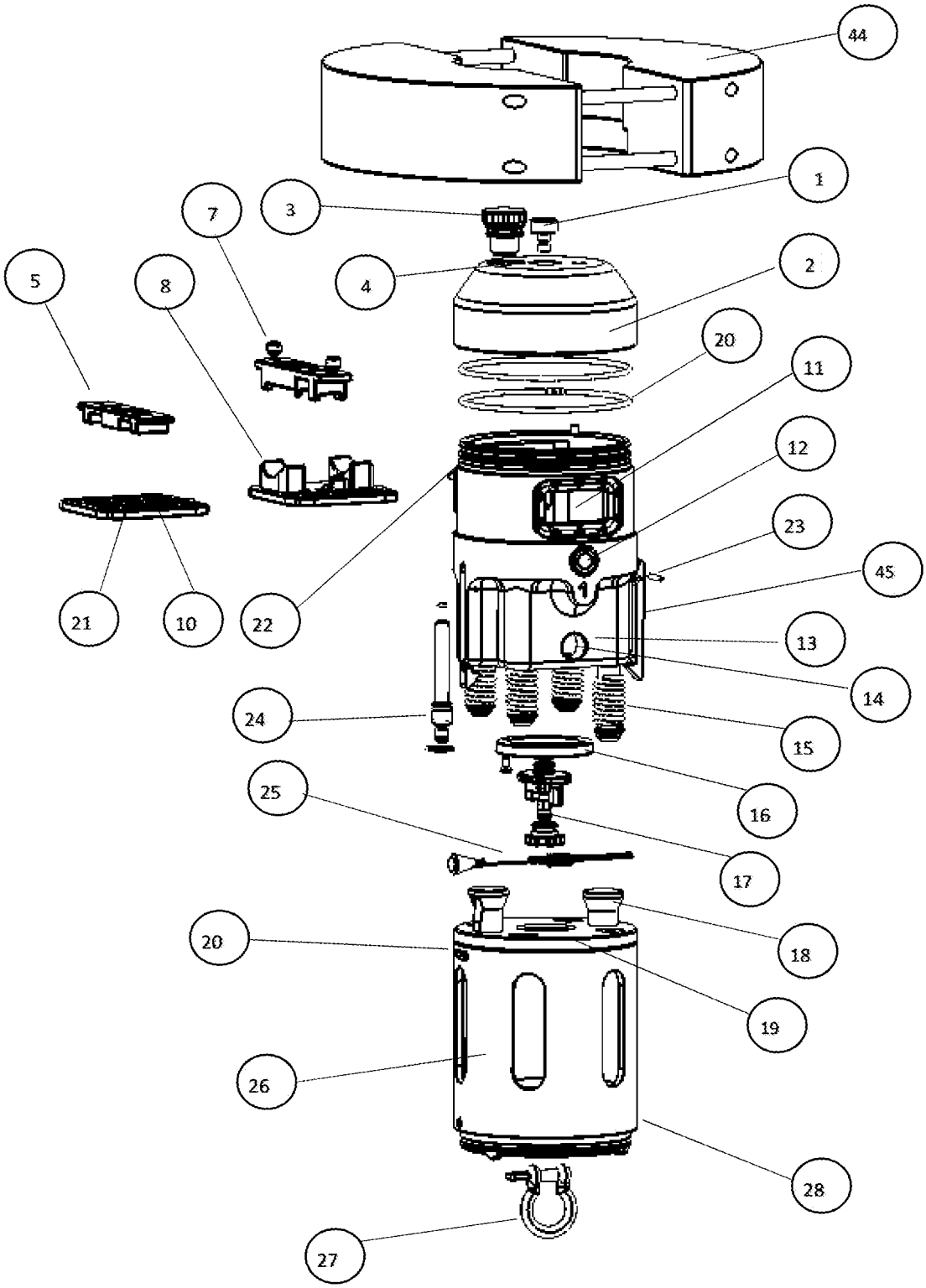
Figure 8:
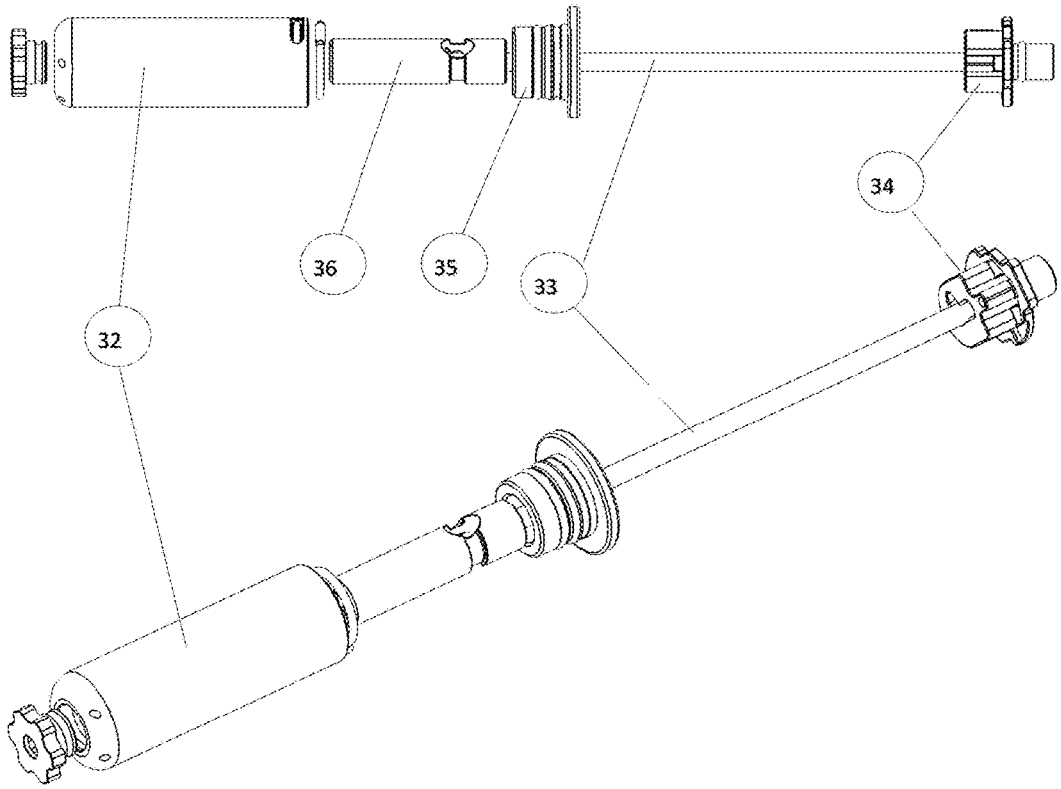
Figure 9:
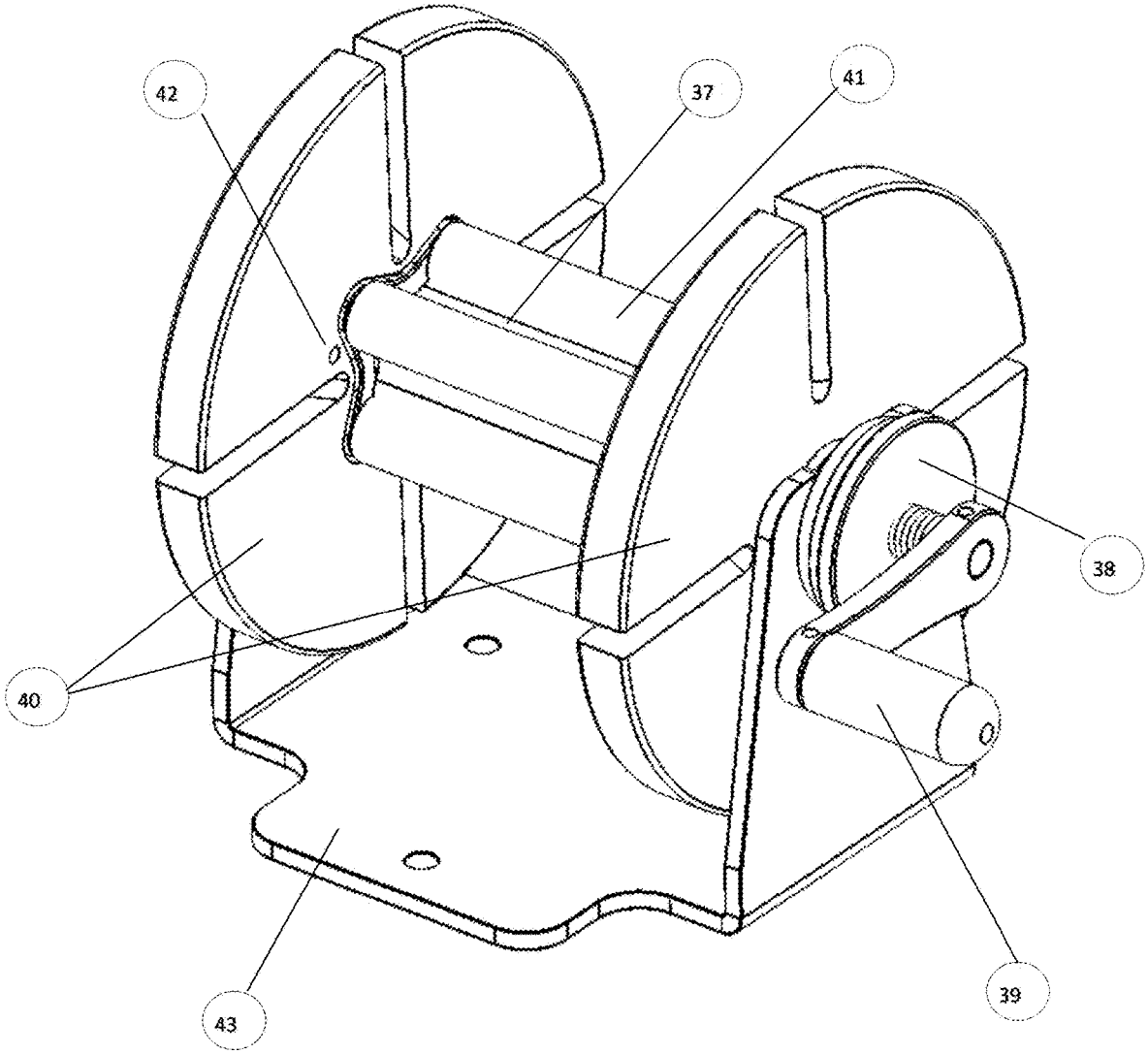
Figure 10:
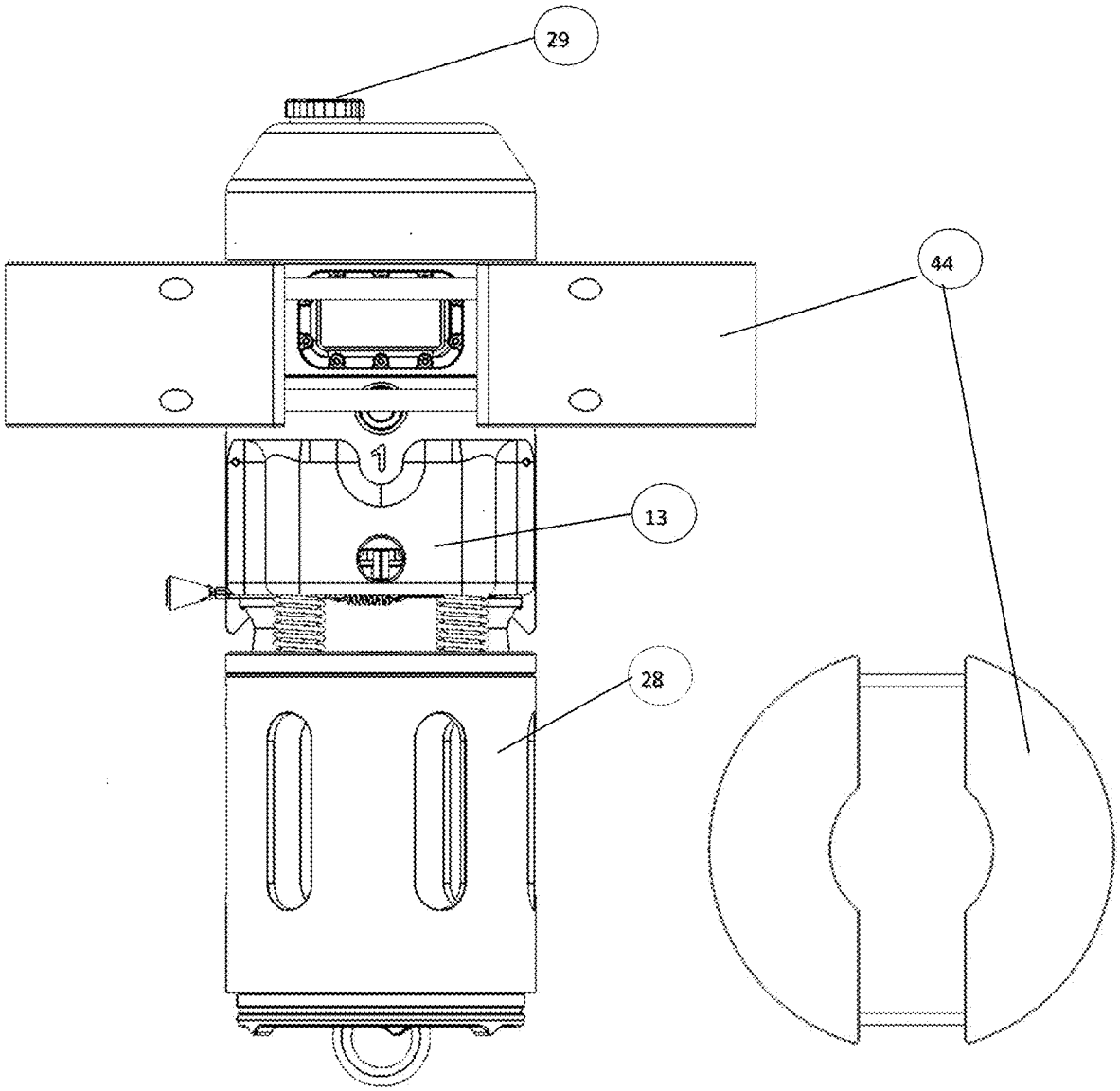

The main floatation device components are:

a. Receivers (not shown).

b. Receiver Housing (FIG. 5).

c. Bracket kit (FIG. 5).

d. Sacrificial Tube Assembly (FIG. 8).

e. Floatation Device Spooler (FIG. 9).

f. Float rings (FIG. 10).

FIGS. 5 to 8 & 10 show the maritime floatation device of the invention. The maritime floatation device is supplied with a number of RFDs that enable the floatation device to be utilised as a maritime based remote firing system. The maritime floatation device is broken down into two main assemblies, namely receiver housing assembly (13) and basket assembly (28).

The floatation device is designed to allow initiation of primarily shock-tube for use under water by preferably non-electric or electric initiation. Shock tube has the necessary properties to be deployed and operated under water at water depths without ingress of water impacting on the reliability. The floatation device provides a solution to be operated with electric and non-electric initiation due to existing user choice.

FIG. 9 shows the spooler used to setup shock tube spools for insertion into the basket assembly.

The maritime floatation device is made up of two main assemblies:

a. Receiver Housing 13. The top part of the maritime floatation device is the receiver housing 13. The housing 13 is capable of holding receivers. The housing material is preferably Acetal using stainless steel and polycarbonate parts where required, minimizing corrosion and magnetic signature.

b. Basket Assembly 28. The bottom part of the maritime floatation device is the basket assembly 28 with a basket housing 26 which is capable of holding a length of shock tube therein (preferably at least up to 100 m of shock tube for an operating depth of 60 m so as to provide stretch and slack when the two housings of the maritime floatation device have separated. The basket assembly 28 material is Acetal.

Figure 5A:
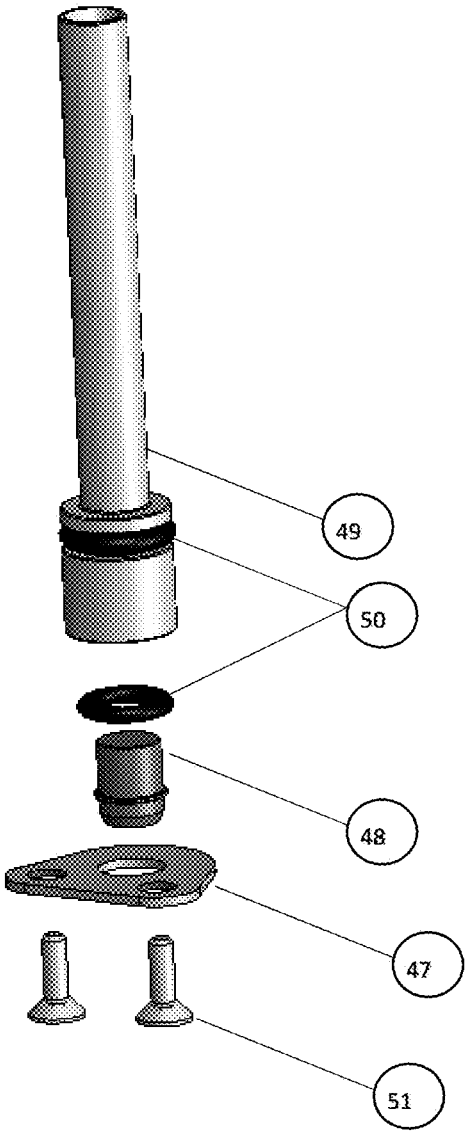
Figure 6:
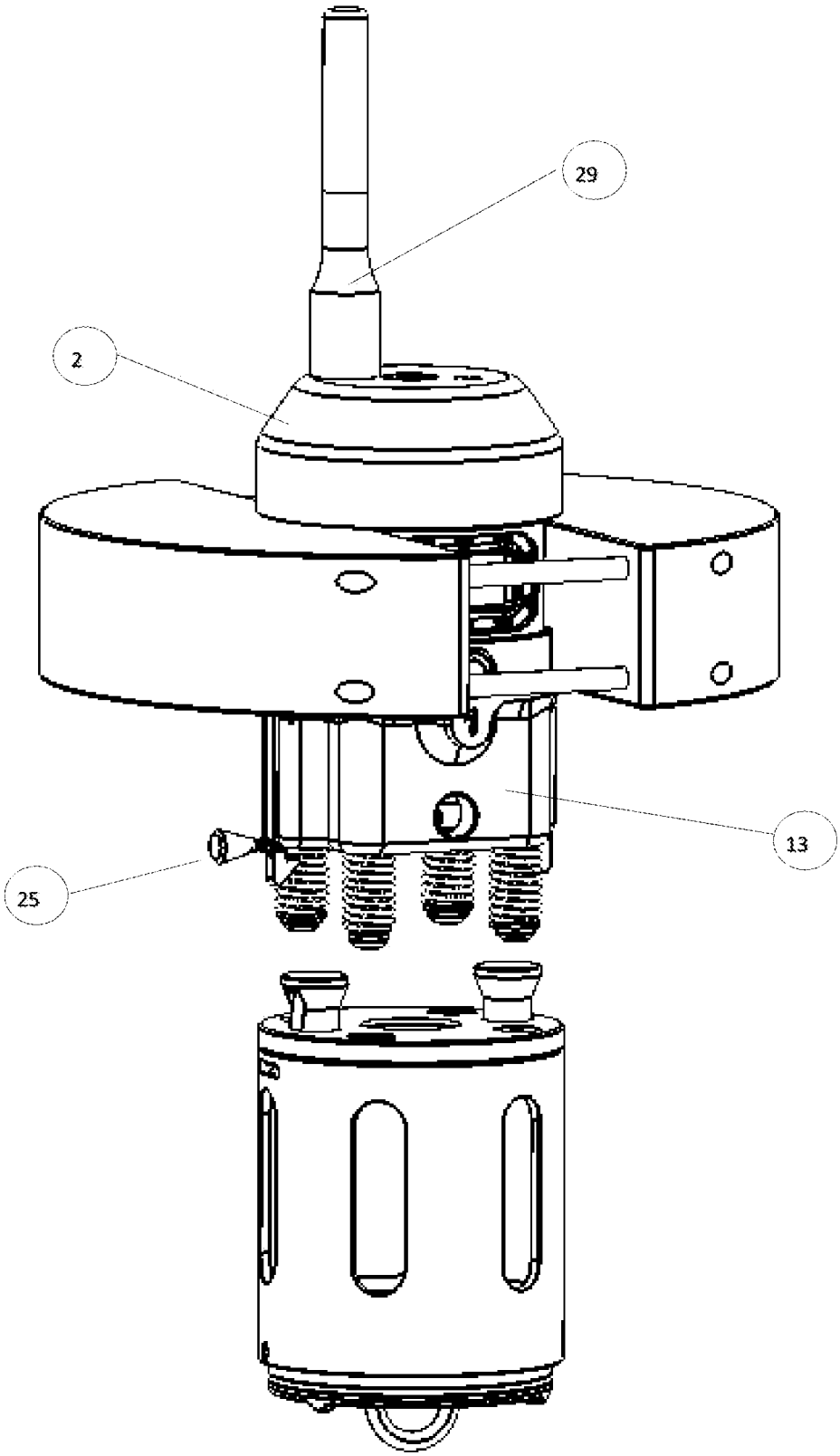
Figure 7:
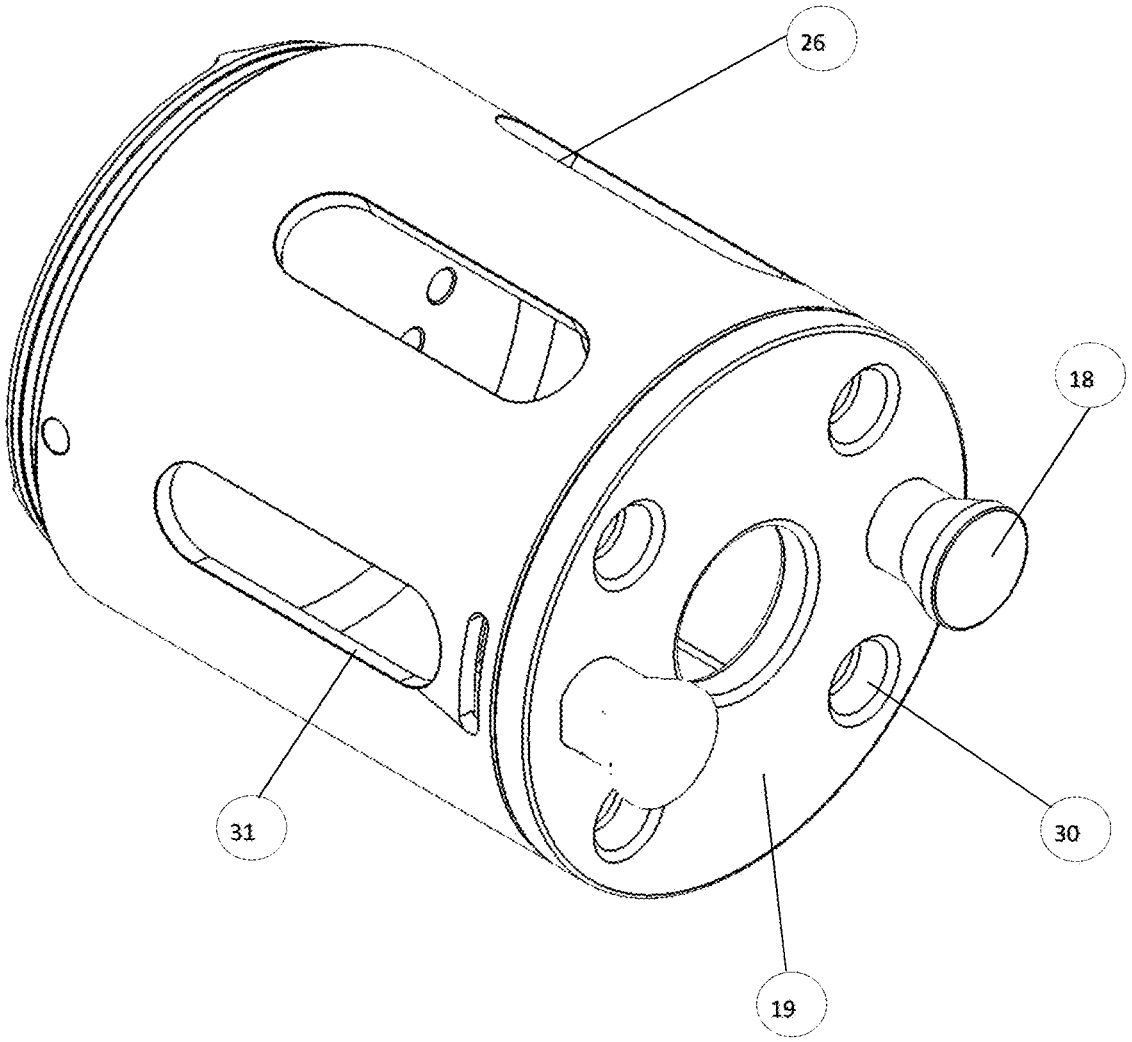
Figure 7A:
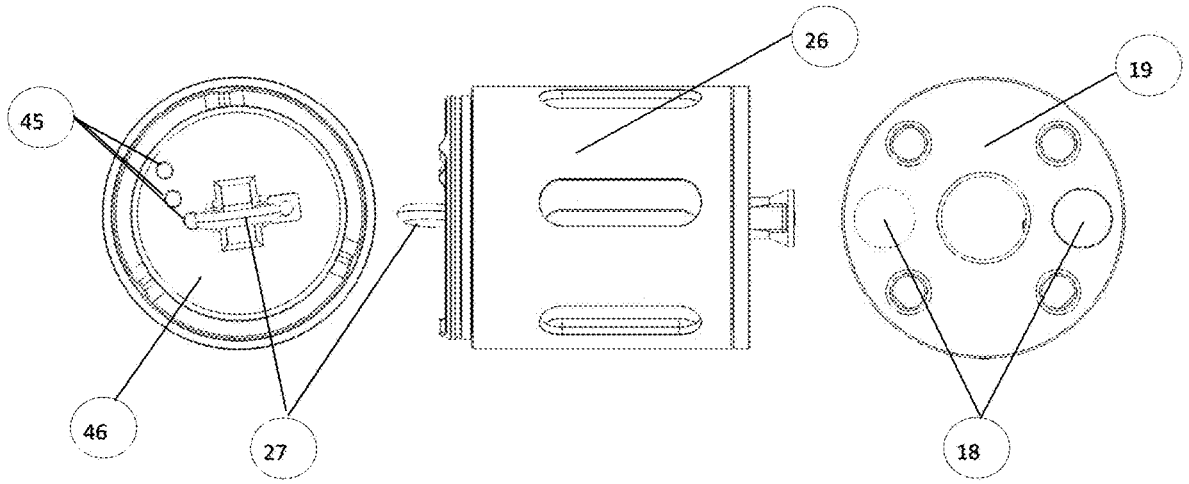

The main body assemblies contain several key components:

i. Receiver Housing Lid 2. The receiving housing lid 2 has on the top center of the lid is the RRx activation push button 1 used to allow button activation of fitted receivers. The lid is secured using locking cord which is fitted through the locking channel, item 22. The locking cord is used to retain the lid to the housing.

ii. Display Windows 11 & Receiver Buttons 12. The floatation device comprises of two display windows 11 and two receiver buttons 12. Only one of each is shown in FIG. 5 as the others are on the other side of the floatation device. These allow external access to operate internally fitted receivers. The display windows allow visual inspection of the receiver displays.

iii. Basket Ejector Arms 45. Integrated into the receiver housing are the basket ejector arms ejector arms 45 which are used to secure the receiver housing to the basket or an alternative interface solution for fixing to the target. The basket ejector arms are pivotally retained to the receiver housing using a pin 23.

iv. Lid Antenna Blanking Cap 3 & 4. The lid antenna blanking cap 3 is used when no external antenna is required. The lid antenna blanking cap 3 fits and seals into the antenna opening 4 in the lid 2.

v. Housing Legs and Launch Springs 15. The receiver housing has four integrated legs with captive stainless steel launch springs 15. The legs aid in alignment when fitting the receiver housing 13 to the basket 26 or alternative interface solution for fixing to the target. The captive springs 15 become compressed and under load when locked to the basket 26. The springs provide the launch force for separation of the receiver housing 13 form the basket 13.

vi. Blade Assembly 24 and FIG. 5*a*. The blade assembly 24 is housed within the receiver housing 13 of separation initiation chamber. The separation initiation chamber is accessed internally to the receiver housing 13 for setup and externally for maintenance. The blade assembly 24 comes fitted with an enclosure FIG. 5*a* 49, cutting blade FIG. 5*a* 48, O-rings for an immersion seal FIG. 5*a* 50 and a plate FIG. 5*a* 47, two retaining bolts FIG. 5*a* 51 are used to retain the assembly in the receiver housing 13. The separation initiation chamber can be operated by a means of electric or non-electric explosive media.

vii. Separation is completed by initiating the explosive media forcing the cutting blade downward cutting the retaining lanyard 25 that is used prior to being cut to assist in retaining the receiver housing 13 to the basket 26. The receiver housing 13 separates and is launched from the basket 26 by the action of the springs 15. The retaining lanyard 25 is spring loaded which secures the basket ejector arms 45 in place when the receiver housing 13 and basket 26 are assembled together. This component is sacrificial and should only be used once. The toggle should always be fitted at the blade assembly side. The lanyard is a unique solution allowing simplicity in assembly by one user.

viii. Gland Plate 16 and Gland Locking Wheel (non-electrical) 17. The gland plate 16 and gland locking wheel 17 (both non-electrical) are used when using shock tube for initiating the main charge. The underside of the receiver housing 13 has the gland plate 16 assembled. This is secured using a push and rotate operation. The gland plate houses 16 the gland locking wheel 17, in order to provide a water tight seal between the ST internal to the receiver housing 13 and ST external to the housing 13.

ix. Securing Void 14. Along the wall of the base of the receiver housing 13 contains a single circular void 14 which is used for general securing and tethering of the maritime floatation device.

x. Shock Tube Retention. Along the wall of the base of the receiver housing 13 contains a single ST retainer which is used to retain the ST for general securing when a single ST initiator is used or dual ST initiator is used.

xi. Locking Cords 20. The use of cord is used to ensure the parts of the assembly do not detach. The locking cord is inserted manually, when the two parts are assembled, into a groove (locking channel) that creates a mechanical obstruction preventing the parts to detach.

xii. Bracket kit 5, 6, 7, 8, 9, 10 & 21. The interface bracket kit is used for different configurations of receivers. The kit is made of a number of top 5 & 7 and bottom brackets 8 & 21. A number of spacers 6 & 9 are also provided to ensure correct fitting of receivers, items 6 and 9. The bracket recess 10 allows for the differing height of the receivers. One can taller than the other. Spacer 9 when used ensures the shorter receiver can be used in the housing. The interface kit ensures receivers are held secure and are located in the correct location for operation.

xiii. Basket Assembly 18, 19, 20, 26, 27, 28, 45 & 46. The basket assembly is used to house and deploy non-electric spools which provide standoff post separation and a non-electrical means for sub-surface initiation to the desired target. The basket assembly comprises of the basket 26, shackle 27 (used for anchorage) and basket lid assembly 19. At the base 45 of the basket 26 are three ST retention holes which allow locking of the ST to provide strain relief. The basket lid 19 has two retaining lugs 18. The retaining lugs 18 are manufactured with at an angle so when the basket ejector arms 45 of the receiver housing 13 clamps over the lugs 18 the ejector arms 45 are forced to open. The lid 19 is secured to the basket using locking cord which is fitted by inserting it into the locking channel 20. The locking method is as per that for the receiver housing lid 2.

xiv. Antenna assembly 29. The floatation device has a number of antenna assemblies for assembling to the receiver housing lid. The assemblies enable the use of quarter and half wave antennas when deploying the reusable receiver. These are used to provide enhanced communication in higher sea states and to support user CONOPS. The antenna assemblies are fitted by removing the lid antenna blanking cap 3. The assemblies have features to allow ease of removal. The O-ring is located in the O-ring channel and creates an immersion seal when screwed into the threaded aperture 7 in the receiver housing lid 2.

xv. Sacrificial tube (FIG. 8). The sacrificial tube provides the ability to initiate ST using an electric detonator. The sacrificial tube fits to the base of the housing 13 and can be fitted once the STA setup is complete. The STA plate allows simple insertion and rotation to a mechanical stop into the receiver housing. The STA plate utilizes an O-ring to provide an immersion seal. To gain access to the sacrificial tube the locking cord is removed and the STA housing 32 separated. The electric detonator cables are fed up the tube from the STA cap end. Upon completion of the Sacrificial Tube Assembly (STA) set up, the cap screw mounted on the STA plate 34 is tightened to create a secondary immersion seal to prevent water ingress post detonator initiation. Once the STA setup is complete the electric detonator cables are connected to the selected electric initiating receiver within the receiver housing.

xvi. Spitfire Adaptors 36. Spitfire Adaptors 36 are used to secure differing detonator sizes. Supplied according to user detonator requirements. The detonator is inserted into the Spitfire adaptor 36 and the adaptor is inserted into the cap 35. The Spitfire adaptor 36 allows for the ST to be inserted parallel down the length of the detonator within the Spitfire by inserting the ST through one of two holes at the top of the upper body of the Spitfire adaptor and around the two recessed holes at the base. This creates a loop to feed the ST back up and parallel to the detonator. This itself secures the ST in the Spitfire and the detonator. The STA housing 32 is secured using locking cord. The locking cord is threaded through the full circumference until it protrudes.

xvii. Spooler (FIG. 9) The spooler comprises of a two piece reeling assembly 40, 41 and a cradle 43. The reel assembly allows the preparation of ST for insertion into the basket 26 pre-prepared for deployment. The spooler comes with a cradle 43 to allow for securing during operation. The locking collar 38 retains the spooler to the cradle during operation. The spooler has a collapsible spool shaft that allows easy removal of prepared ST spools. The spool shaft collapses when the detachable plate 42 is removed. The spool shaft 41 and end plates 40 allow cable ties to be inserted under the spooled ST and secure the ST preventing it from unspooling.

xviii. Float Ring (FIG. 10). The floatation device is provided with a float ring 44. The float ring is constructed using a special buoyant foam and carbon fibre securing pins bolts of equal length. The float ring provides the user the choice for use depending on operation, tactical situation and sea state. The float ring provides buoyancy and enhanced stability for the float when deployed. Fitting the float ring to the receiver housing does not impede the view of the display windows or functionality of the button assemblies.

Unique Design Features:

Launch system with sacrificial retaining lanyard. This combination allows the user to setup the floatation device easily as well as provide the necessary launch mechanism when the receiver housing and basket assembly separate. The lanyard is designed to:

- Keeps tension on the basket ejector arms preventing the two main assemblies from separating.
- Allow to be severed by the blade assembly allowing separation.
- Allowing a single user to easily assemble the two main assemblies together with no additional tools or second user.

Uniquely integrate existing RPD systems into the receiver housing using the bracket kit.

Float ring design to provide additional buoyancy at the water surface for sea states >1. The float ring allows continued use and visual confirmation of the mounted receiver internally.

SPITFIRE is part of the sacrificial tube and designed to retain shock tube close to the explosive section of the detonator for detonation. The spitfire prevents crushing damage to the detonator as well as ensures the ST runs parallel and next to the detonator for initiation. The spitfire when assembled into the STA provides a seal preventing water access to the detonator that would impact on detonator initiation.

Locking mechanism used for retaining the lid 2 of the receiver housing 13, lid 19 of the basket 26 and the STA housing 32 to the cap 35.

The spooler utilizes a collapsing shaft mechanism for easy removal of spooled ST and a design feature allowing cable ties to be assembled around the ST spool to keep the spooled shape. The spool end plate is detachable allowing the shock tube spool to be removed from the spool. The spool is retained to the cradle using the locking collar.

Figure 11:
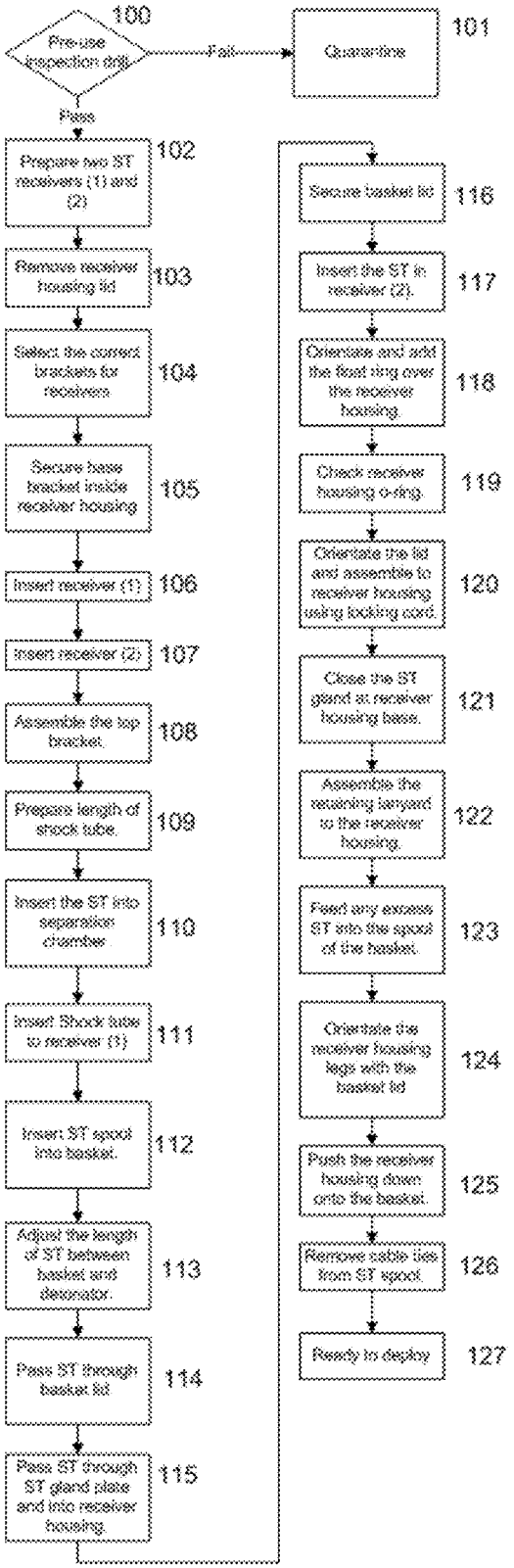

In order to support the operational scenarios the general operational steps involved in set-up are as per FIG. 11 dual ST receiver setup. Pre-setup is recommended before setting up the floatation device to ensure efficient setup. It is recommended that all receivers are setup into the corresponding modes of operation and at least a single spool of shock tube is available for insertion into the basket. During installation of receiver(s) into the receiver housing the necessary connections are made internally for the main charge and if required connections to operate the separation feature.

Firstly a pre inspection drill 100 of the floatation device is undertaking, if the device fails the inspection it is quarantined 101. If inspection drill is passed then two shock tube (ST) receivers are prepared 102, one for timed initiation mode and the other for remote initiation mode. The lid of the receiver housing is removed 103. Selecting the correct top and bottom brackets for receivers 104 and securing the base bracket inside receiver housing 105. The first receiver that is used for the float separation is switched on and inserted 106. The second receiver that is used for the main charge is inserted 107. The top bracket is assembled 108 so as to clamp the receivers firmly into place. A length of shock tube is prepared 109 and shock tube is inserted in to the separation chamber 110. Shock tube is inserted in to the first receiver 111 after BIT test is completed.

The spool is inserted into the basket 112. Taking the end with the pre-fitted detonator and passing through the three strain relief holes in the base of the basket. Adjusting the length of ST between the basket and detonator 113. The length of ST will be according to user requirements/specific tasks.

Pass the ST through the centre hole of basket lid 114. Ensure the receiver housing gland locking wheel is open then take the spare end of ST internal to the spool 115 that will be fed into the receiver housing through the gland locking wheel and the gland plate.

Assembling and securing the lid to the basket using the locking cord 116 making sure the ST is pulled through the centre lid hole.

Trim the running end of ST according to manufacturer recommendations to ensure a dry and square cut prior to insertion into the main charge receiver. Insert the ST through the gland locking wheel and into the receiver housing. Turning the second receiver on by pushing the external push button. Insert the ST in the second receiver 117 once the BIT test is complete.

Orientate and assemble the float ring over the receiver housing 118. Check receiver O-ring for damage 119. Orientate, assemble and secure the lid to the receiver housing 120.

Closing the gland locking wheel on the receiver housing base to provide a watertight seal 121. Assembling the retaining lanyard to the receiver housing 122 such that the ejector arms should move freely but retain tension keeping the ejector arms in the closed position. Secure the ST in the ST retainer and feed any excess ST on to the spool of the basket 123.

The receiver housing legs are orientated and positioned with respective holes in the basket lid 124. The receiver housing is then pushed down onto the basket 125. Finally the cable ties are removed from the spool 126 and final top down checks completed. The floatation device is now ready to be deployed 127.

Figure 12:
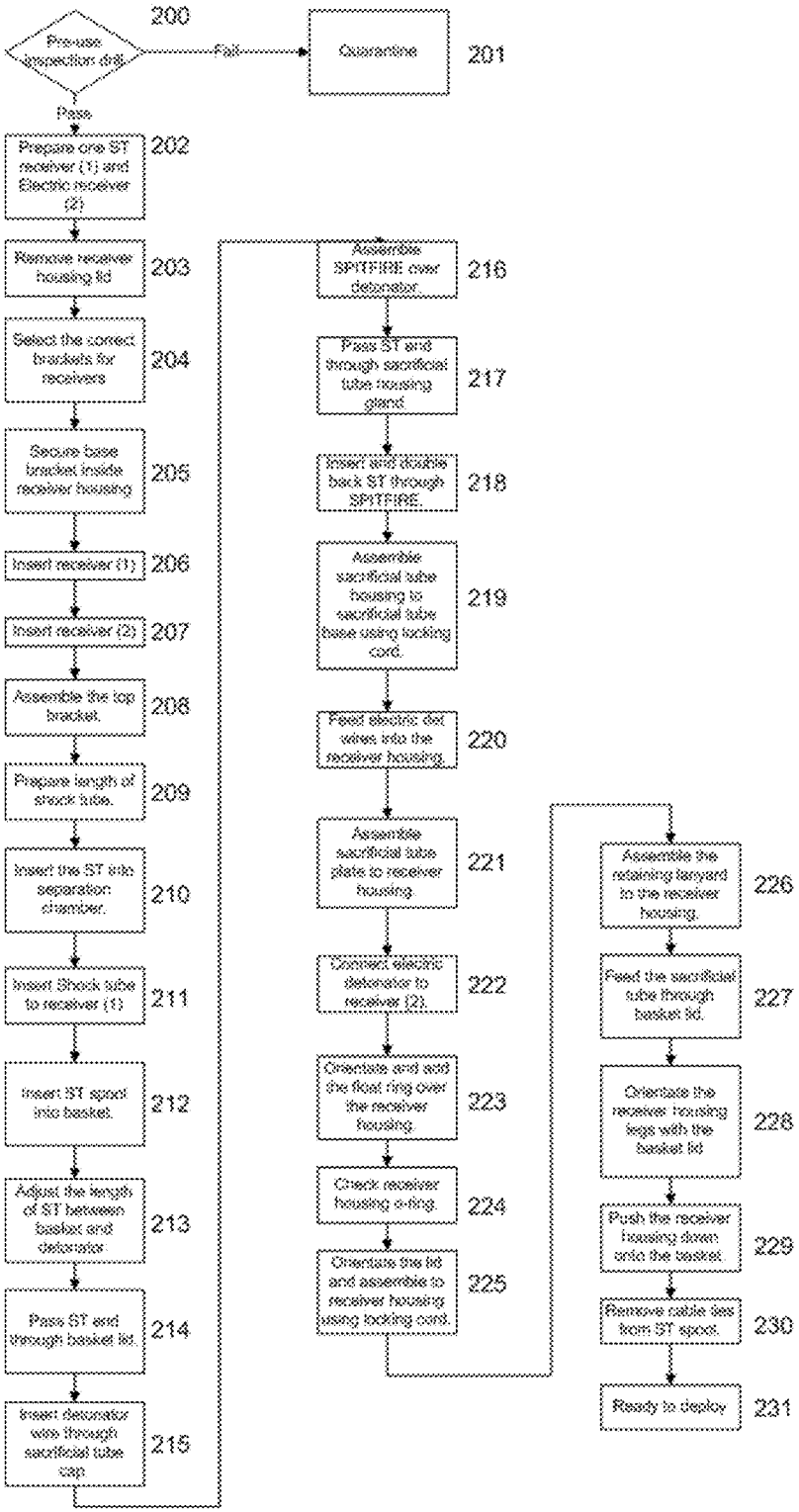

In order to support the operational scenarios the general operational steps involved in set-up are as per FIG. 12 single ST and single electric receiver setup. Pre-setup is recommended before setting up the floatation device to ensure efficient setup. It is recommended that all receivers are setup into the corresponding modes of operation and at least a single spool of shock tube is available for insertion into the basket. During installation of receiver(s) into the receiver housing the necessary connections are made internally for the main charge and if required connections to operate the separation feature.

Firstly a pre inspection drill 200 of the floatation device is undertaking, if the device fails the inspection it is quarantined 201. If inspection drill is passed then one ST receiver and one electric receiver are prepared 202, one ST receiver setup for timed initiation mode and the one electric receiver for remote initiation mode 202. The lid of the receiver housing is removed 203. Selecting the correct top and bottom brackets for receivers 204 and securing the base bracket inside receiver housing 205. The first receiver that is used for the float separation is switched on and inserted 206. The second receiver that is used for the main charge is inserted 207. The top bracket is assembled 208 so as to clamp the receivers firmly into place. A length of shock tube is prepared 209 and shock tube is inserted in to the separation chamber 210. Shock tube is inserted in to the first receiver 211 after BIT test is completed.

The spool is inserted into the basket 212. Taking the end with the pre-fitted detonator and passing through the three strain relief holes in the base of the basket. Adjusting the length of ST between the basket and detonator 213. The length of ST will be according to user requirements/specific tasks.

Pass the ST through the centre hole of basket lid 214. Setup and assemble the electric detonator in the STA by inserting the detonator from the STA cap end through the tubing 215. Assemble and setup the spitfire 216. Take the spare end of ST internal to the spool that will be fed through the STA housing gland 217. Insert and double back the ST through the spitfire 218. Complete assembly of STA by assembling and locking the STA housing to the STA cap by inserting the locking cord into the locking channel 219. Feed the electric detonator wires into the receiver housing 220 and assemble the STA plate to the base of the receiver housing 221.

Connect the electric detonator wires to the electric receiver terminals once the BIT test is complete 222.

Orientate and assemble the float ring over the receiver housing 223. Check receiver O-ring for damage 224. Orientate, assemble and secure the lid to the receiver housing 225.

Assembling the retaining lanyard to the receiver housing 226 such that the ejector arms should move freely but retain tension keeping the ejector arms in the closed position. Feed the STA through the basket lid aperture 227. The receiver housing legs are orientated and positioned with respective holes in the basket lid 228. The receiver housing is then pushed down onto the basket 229. Finally the cable ties are removed from the spool 230 and final top down checks completed. The floatation device is now ready to be deployed 231.

Figure 13:
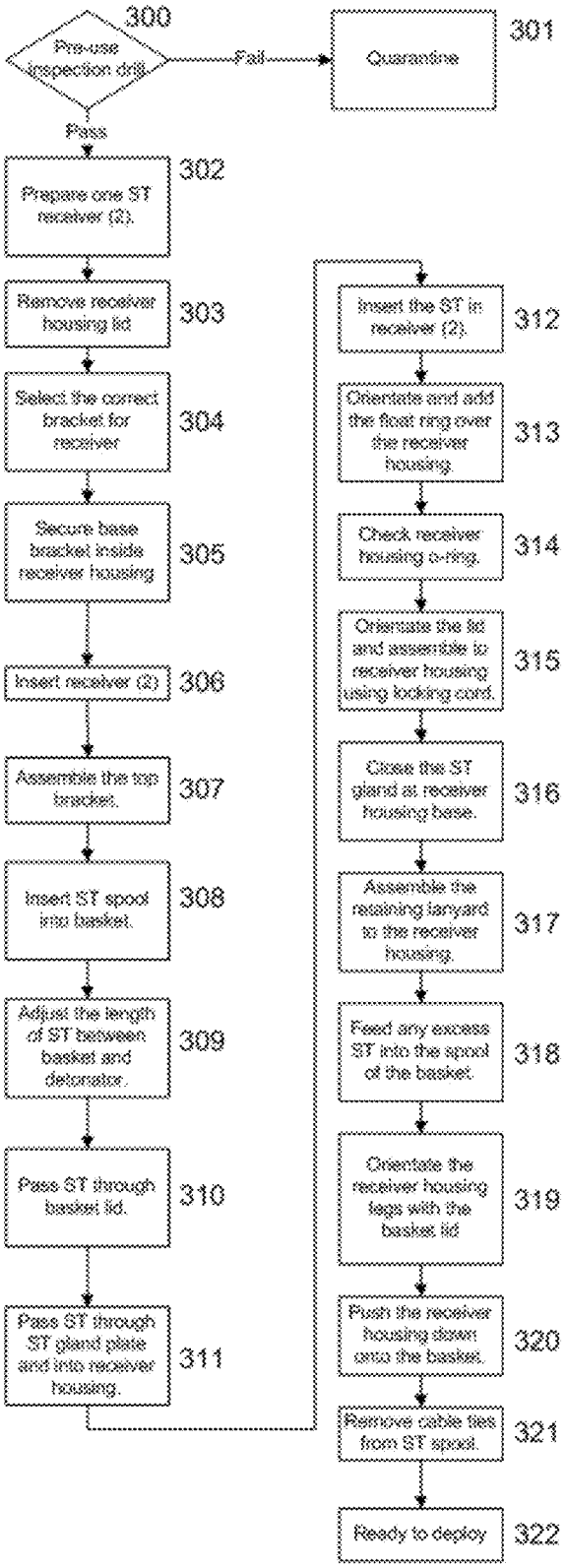

In order to support the operational scenarios the general operational steps involved in set-up are as per FIG. 13 single ST receiver setup. Pre-setup is recommended before setting up the floatation device to ensure efficient setup. It is recommended that all receivers are setup into the corresponding modes of operation and at least a single spool of shock tube is available for insertion into the basket. During installation of receiver(s) into the receiver housing the necessary connections are made internally for the main charge and if required connections to operate the separation feature.

Firstly a pre inspection drill 300 of the floatation device is undertaking, if the device fails the inspection it is quarantined 301. If inspection drill is passed then one shock tube (ST) receiver is prepared 302 for timed or remote initiation mode. The lid of the receiver housing is removed 303. Selecting the correct top and bottom brackets for receivers 304 and securing the base bracket inside receiver housing 305. The single ST receiver used for the main charge is inserted 306 into receiver location 2. The top bracket is assembled 307 so as to clamp the receiver firmly into place.

The spool is inserted into the basket 308. Taking the end with the pre-fitted detonator and passing through the three strain relief holes in the base of the basket. Adjusting the length of ST between the basket and detonator 309. The length of ST will be according to user requirements/specific tasks.

Pass the ST through the centre hole of basket lid and assembling and securing the lid to the basket using the locking cord making sure the ST is pulled through the centre lid hole.

310. Ensure the receiver housing gland locking wheel is open then take the spare end of ST internal to the spool 311 that will be fed into the receiver housing through the gland locking wheel and the gland plate.

Trim the running end of ST according to manufacturer recommendations to ensure a dry and square cut prior to insertion into the main charge receiver. Insert the ST through the gland locking wheel and into the receiver housing. Turning the second receiver on by pushing the external push button. Insert the ST in the second receiver 312 once the BIT test is complete.

Orientate and assemble the float ring over the receiver housing 313. Check receiver O-ring for damage 314. Orientate, assemble and secure the lid to the receiver housing 315.

Closing the gland locking wheel on the receiver housing base to provide a watertight seal 316. Assembling the retaining lanyard to the receiver housing 317 such that the ejector arms should move freely but retain tension keeping the ejector arms in the closed position. Secure the ST in the ST retainer and feed any excess ST on to the spool of the basket 318.

The receiver housing legs are orientated and positioned with respective holes in the basket lid 319. The receiver housing is then pushed down onto the basket 320. Finally the cable ties are removed from the spool 321 and final top down checks completed. The floatation device is now ready to be deployed 322.

Figure 14:
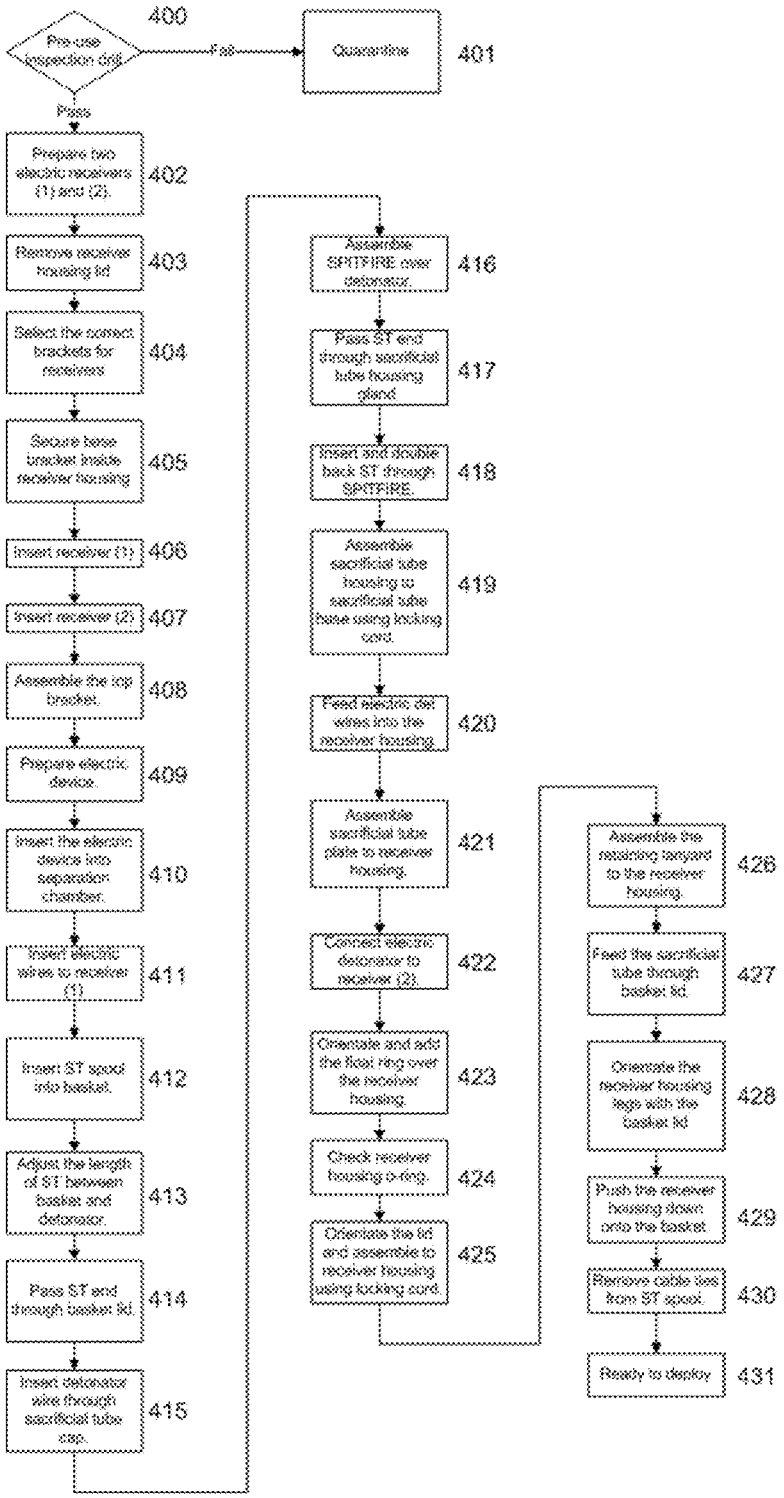

In order to support the operational scenarios the general operational steps involved in set-up are as per FIG. 14 dual electric receiver setup. Pre-setup is recommended before setting up the floatation device to ensure efficient setup. It is recommended that all receivers are setup into the corresponding modes of operation and at least a single spool of shock tube is available for insertion into the basket. During installation of receiver(s) into the receiver housing the necessary connections are made internally for the main charge and if required connections to operate the separation feature.

Firstly a pre inspection drill 400 of the floatation device is undertaking, if the device fails the inspection it is quarantined 401. If inspection drill is passed then both electric receivers are prepared 402, one electric receiver setup for timed initiation mode and the one electric receiver for remote initiation mode 402. The lid of the receiver housing is removed 403.

Selecting the correct top and bottom brackets for receivers 404 and securing the base bracket inside receiver housing 405. The first receiver that is used for the float separation is switched on and inserted 406. The second receiver that is used for the main charge is inserted 407. The top bracket is assembled 408 so as to clamp the receivers firmly into place. Prepare the electric device 409 and insert in to the separation chamber 410. Inserted the electric device cables in to the first receiver 411 after BIT test is completed.

The spool is inserted into the basket 412. Taking the end with the pre-fitted detonator and passing through the three strain relief holes in the base of the basket. Adjusting the length of ST between the basket and detonator 413. The length of ST will be according to user requirements/specific tasks.

Pass the ST through the centre hole of basket lid 414. Setup and assemble the electric detonator in the STA by inserting the detonator from the STA cap end through the tubing 415. Assemble and setup the spitfire 416. Take the spare end of ST internal to the spool that will be fed through the STA housing gland 417. Insert and double back the ST through the spitfire 418. Complete assembly of STA by assembling and locking the STA housing to the STA cap by inserting the locking cord into the locking channel 419. Feed the electric detonator wires into the receiver housing 420 and assemble the STA plate to the base of the receiver housing 421.

Connect the electric detonator wires to the electric receiver terminals once the BIT test is complete 422.

Orientate and assemble the float ring over the receiver housing 423. Check receiver O-ring for damage 424. Orientate, assemble and secure the lid to the receiver housing 425.

Assembling the retaining lanyard to the receiver housing 426 such that the ejector arms should move freely but retain tension keeping the ejector arms in the closed position. Feed the STA through the basket lid aperture 427. The receiver housing legs are orientated and positioned with respective holes in the basket lid 428. The receiver housing is then pushed down onto the basket 429. Finally the cable ties are removed from the spool 430 and final top down checks completed. The floatation device is now ready to be deployed 431.

Figure 15:
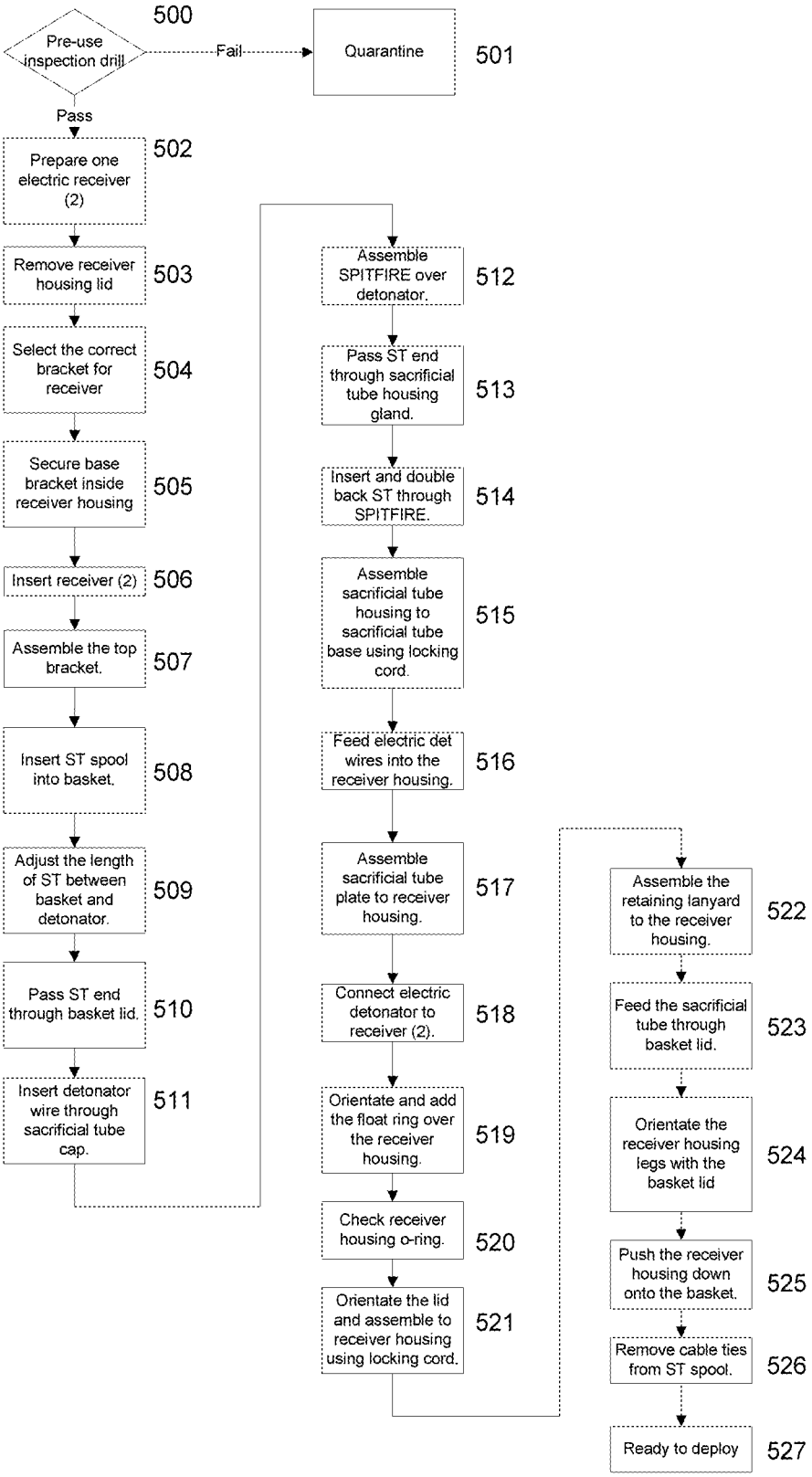

In order to support the operational scenarios the general operational steps involved in set-up are as per FIG. 15 single electric receiver setup. Pre-setup is recommended before setting up the floatation device to ensure efficient setup. It is recommended that all receivers are setup into the corresponding modes of operation and at least a single spool of shock tube is available for insertion into the basket. During installation of receiver(s) into the receiver housing the necessary connections are made internally for the main charge and if required connections to operate the separation feature.

Firstly a pre inspection drill 500 of the floatation device is undertaking, if the device fails the inspection it is quarantined 501. If inspection drill is passed then both electric receivers are prepared 502, one electric receiver setup for timed or remote initiation mode 502. The lid of the receiver housing is removed 503. Selecting the correct top and bottom brackets for receivers 504 and securing the base bracket inside receiver housing 505. The electric receiver used for the main charge is inserted into receiver location 2, 506. The top bracket is assembled 507 so as to clamp the receivers firmly into place.

The spool is inserted into the basket 508. Taking the end with the pre-fitted detonator and passing through the three strain relief holes in the base of the basket. Adjusting the length of ST between the basket and detonator 509. The length of ST will be according to user requirements/specific tasks.

Pass the ST through the centre hole of basket lid 510. Setup and assemble the electric detonator in the STA by inserting the detonator from the STA cap end through the tubing 511. Assemble and setup the spitfire 512. Take the spare end of ST internal to the spool that will be fed through the STA housing gland 513. Insert and double back the ST through the spitfire 514. Complete assembly of STA by assembling and locking the STA housing to the STA cap by inserting the locking cord into the locking channel 515. Feed the electric detonator wires into the receiver housing 516 and assemble the STA plate to the base of the receiver housing 517.

Connect the electric detonator wires to the electric receiver terminals once the BIT test is complete 518.

Orientate and assemble the float ring over the receiver housing 519. Check receiver O-ring for damage 520. Orientate, assemble and secure the lid to the receiver housing 521.

Assembling the retaining lanyard to the receiver housing 522 such that the ejector arms should move freely but retain tension keeping the ejector arms in the closed position. Feed the STA through the basket lid aperture 523. The receiver housing legs are orientated and positioned with respective holes in the basket lid 524. The receiver housing is then pushed down onto the basket 525. Finally the cable ties are removed from the spool 526 and final top down checks completed. The floatation device is now ready to be deployed 527.

The receiver housing is capable of holding a number of receivers that are secured internally using a bracket kit. The choice of receivers to be used within the floatation device is according to the operation being performed. The floatation device can be used to complete four major operational capabilities, for example as shown in FIGS. 1 to 4.

Separation of the basket and receiver housing can be completed two methods.

1. Manually by the diver. Cutting the retaining lanyard with a tool. Only a single receiver assembled in the receiver housing.
2. Initiating the mounted cutting blade using time delay. Cutting blade is initiated by the use of ISFE (electric) or shock tube. Two receivers assembled in the receiver housing.

For separation, a time delay is setup on the first receiver and is used to initiate the non-electric or electric explosive media. The initiation of the non-electric or electric explosive media causes the air to expand in the separation chamber forcing the blade assembly down. This motion cuts the nylon wire of the sacrificial tube severing the lanyard. The lanyard basket ejector arms are then forced open by the force of the launch springs and the angle of the basket lid lugs. With the basket tethered to the target the buoyant receiver housing floats to the surface to allow the user to complete remote initiation.

The maritime floatation device can initiate weapon systems that prevent the need for expensive UUV combat rounds and if deployed as part of a weapon system on a UUV, the UUV is able to be re-used. The maritime floatation device allows the user to initiate a weapon system or explosive charge under remote command as single or multiple deployment that can be covert or overt.

The maritime floatation device is required to enhance the operational capability of a land based RFD for operation within the increasing threats of the maritime environment and demand by associated maritime user groups. This provides a single solution to user groups meeting several operational capabilities.

The maritime floatation device is required to extend the safety aspect and reliability of initiating detonators/detonating explosives. Safety in this context means to ensure the unintentional initiation of detonators during the setup/deployment of the maritime floatation device during operation. Unintentional initiation can be catastrophic.

The maritime floatation device provides the ability for the user to conduct operations within very shallow water, shallow water and deep water.

There is a need to conduct surface initiations over short and long distance remotely and sub-surface initiation using timed delay. The maritime floatation device is able to be set-up and deployed for surface deployment so that it can be remotely initiated over distance. The maritime floatation device is able to be set-up and deployed for sub-surface deployment so that it will self-release to the surface using a timed delay.

The maritime floatation device is capable of holding a combination of existing receivers to conduct the necessary operations aforementioned (see FIGS. 1 to 4).

The maritime floatation device is able to be deployed in covert or overt operations under or above the waterline within the hinterland. The solution shall be agile, quick to setup and basic to deploy.

The maritime floatation device allows the user to deploy underwater without causing issues with diver buoyancy changing existing deployment strategies.

The maritime floatation device allows single or multiple floats to be deployed to suit the operation and is remotely initiated individually or simultaneously under one control.

The maritime floatation device is able to be deployed underwater by diver or by autonomous equipment.

The maritime floatation device is able to be deployed above the water by boat, diver or by autonomous equipment.

The maritime floatation device uses materials that do not impact on safety and the environment and allow it to be utilised at the required depths without water immersion.

The maritime floatation device is quick to setup from its resting place to start of deployment.

Technical Data for the Floatation Device.

| Dimensions: | |
|---|---|
| Receiver Housing assembly only with antenna cap fitted and without float ring assembled | 280 mm (H) × 140 mm (D) |
| Basket assembly only with lid and basket bow shackle fitted | 180 mm (H) × 140 mm (D) |
| Receiver Housing with antenna cap & Basket assembly | 420 mm (H) × 140 mm (D) |
| Float Ring assembled | 75 mm (H) × 340 mm (D) |
| Receiver Housing coupled to basket assembly, antenna cap and float ring assembled | 425 mm (H) × 340 mm (D) |
| Receiver Housing coupled to basket assembly, ¼ wave antenna shroud and float ring assembled | 585 mm (H) × 340 mm (D) |
| Receiver Housing coupled to basket assembly, ½ wave antenna shroud and float ring assembled | 815 mm (H) × 340 mm (D) |
| Receiver Housing coupled to basket assembly, antenna cap, float ring and magnetic base and lid assembled | 485 mm (H) × 340 mm (D) |
| Receiver Housing coupled to basket assembly, ¼ wave antenna shroud, float ring and magnetic base and lid assembled | 645 mm (H) × 340 mm (D) |
| Receiver Housing coupled to basket assembly, ½ wave antenna shroud, float ring and magnetic base and lid assembled | 875 mm (H) × 340 mm (D) |
| Weight: | |
| Receiver housing, basket with antenna cap and float ring assembled. No receivers or interface kit. | ~3.6 Kg |
| Receiver housing, basket with antenna cap, receiver interface kit and float ring assembled. Setup as STIX only. | ~4.1 Kg |
| Receiver housing, basket with antenna cap, receiver interface kit and float ring assembled. Setup as STIX/STIX. | ~4.6 Kg |
| Receiver housing, basket with antenna cap and float ring, ¼ wave shroud assembled. Setup as RRx only. | ~4.8 Kg |
| Receiver housing, basket with antenna cap and float ring, receiver interface kit, ¼ wave shroud assembled. Setup as STIX/RRx. | ~5.2 Kg |
| Magnetic Base with cover and locking cords | ~1.5 kg |
| Housing materials: | |
| Receiver housing, Basket, lids, antenna assembly | Acetal - Black |
| Display Windows | Polycarbonate - Clear |
| Cradle ejector arms, basket bow shackle, spring, captive screws | Stainless steel |

-continued

| | |
|---|---|
| Retaining lanyard | Nylon |
| O-rings | Rubber (Nitrile) |
| Float ring | Syntactic foam (coated black rubber) |
| ACR Firefly Plus Strobe and torch | ABS (Housing) |
| Operating Range in Sea State 3 & 0.5 knots: | |
| Reusable Receiver - RRx | Up to 17 km LOS (dependent on transmitter location) |
| Expendable Receiver - STIX | Up to 2 km LOS (dependent on transmitter location) |
| Current flow: | |
| Operational separated state | 2 knots (impacts LOS range) |
| Deploy single system by diver without aid | Recommend <1 knot |
| Deploy single system by underwater scooter | Recommend for deployment conditions of >1 knot |
| Man Machine Interface: | |
| Diver gloves | Operate using </=5 mm neoprene gloves |
| Visibility | >10 cm below the waterline |
| Battery Life: (+25° C.) | |
| ACR Firefly Plus strobe and torch | 10 hrs strobe (Alkaline LR6)<br>2 hrs torch (Alkaline LR6) |
| Environmental Specification: | |
| POP π immersion rating without additional aid | Operated down to 60 m<br>Transportable down to 100 m |
| ACR Firefly Plus strobe and torch | 100 m |
| Operating Temperature | −30° to +60° C. |
| Storage Temperature: | −30° to +70° C. |

ITEM LISTING

MFD Maritime Floatation Device
RFD Remote Firing Device
M Mine
AP Anchor Point
D Sea Depth
TC Timer Countdown Device
1—Push button and actuation stem
2—Lid
3—Blanking cap
4—Antenna opening
5—Top Bracket 1
6—Spacer
7—Top Bracket 2
8—Bottom bracket 1
9—Spacer
10—Bottom bracket 2 recess
11—Window ($2^{nd}$ window on opposite side)
12—Push Button ($2^{nd}$ push button on opposite side)
13—Receiver housing
14—Securing void
15—Launch spring
16—Gland plate (non-electrical)
17—Gland locking wheel (non-electrical)
18—Retaining lug
19—Basket lid
20—Locking cord channel
21—Bottom bracket 2
22—Locking cord channel
23—Ejector arms retaining pin
24—Blade assembly
25—Retaining lanyard
26—Basket housing
27—Shackle
28—Basket Assembly
29—Antenna assembly
30—Basket lid receiver housing orientation holes
31—Basket housing recesses
32—STA housing
33—Tubing
34—STA plate (electrical)
35—STA Cap
36—Spitfire
37—Recess (×3)
38—Locking spigot
39—Handle
40—End plate
41—Collapsible spool shaft
42—Retaining hole
43—Clamp
44—Float rings
45—ST retention holes
46—Basket housing base Advantages Summary of Advantages for the Invention:

Multiple capabilities with same Remote Firing Device (RFD).
Flexible system with four modes of deployment—compared to one.
Covert and overt.
Re-usable or sacrificial.
Electric or non-electric initiation.
Time or remote initiation options.
Alternative connection options for securing to target.
Neutrally buoyant for underwater deployment.
Clandestine deployment and operation.
Low cost—in comparison to other options.
Quick setup time.
Simple to deploy above or below the water.
Significant depth ability.
No physical link between the operator and the explosive charge.
Can be immersed down to 60 m.

Slim line form factor for stowage, transportation and deployment manually or autonomously.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein described in the appended claims.

The invention claimed is:

1. A maritime floatation device for using remote firing devices above and below a water line by way of non-electric or electric initiation, the maritime floatation device includes:

a) a receiver housing having a combination of at least two receivers connectable via a shock tube to respective explosive means, one receiver is adapted for timed initiation for separation and the second receiver adapted for remote initiation or timed initiation in order to meet the desired required operational capabilities of the maritime floatation device;

b) a releasable basket housing connected to receiver housing;

c) retention means for retaining two housings together;

d) separation means for deactivating the retention means so as to allow for separation the receiver housing from the basket housing upon an activation of the separation means by the respective explosive means initiated from a timed initiated receiver;

e) a shock tube spool position able within the basket housing wherein the spool accommodates and includes a length of shock tube that is connectable to the second receiver and to explosive means so as to allow flexibility in deployment of the maritime floatation device to suit a desired standard operating procedures; and/or f) floats attachable to the receiver housing so as to allow receiver housing to float to the surface once the receiver housing is separated from the basket housing; wherein the maritime floatation device allows non-electric or electric initiation of shock-tube with properties able to be deployed and operated under water at water depths without ingress of water impacting on the reliability of the maritime floatation device.

2. The maritime floatation device as claimed in claim 1, wherein the basket housing is capable of holding a length of up to 500 m of the shock tube on the spool so that the maritime floatation device is operable to depths within surface and 400 m and to provide stretch and slack between the two housings once the two housings of the maritime floatation device have been separated.

3. The maritime floatation device as claimed claim 1, wherein the receiver housing has pivotally mounted downwardly depending ejector arms which cooperatively engage with jaw receiving means mounted on the basket housing, the ejector arms are retained in a clamping action with the jaw receiving means by the retention means so as to releasably secure the receiver and basket housings together, wherein the jaw receiving means are retaining lugs, the retaining lugs include an angled surface so as to assist in the releasing and opening of the elector arms upon deactivation of the retention means by the separation means to allow the two housings to separate from one another.

4. The maritime floatation device as claimed in claim 3, wherein the receiver housing has a lid with a RRx activation push button to allow for button activation of the receivers within the receiver housing, the lid presenting an aperture adapted to accommodate an accommodate an antenna or a water tip cap if no antenna is required, wherein the lid is secured to the housing by a locking cord, the locking cord is fitted through a locking channel in the housing.

5. The maritime floatation device as claimed in claim 1, wherein the receiver housing has two display windows and two receiver buttons so as to allow visual inspection of the receiver displays and external access to operate the internally fitted receivers within the housing.

6. The maritime floatation device as claimed in claim 1, wherein the receiver housing has at least two spaced apart downwardly depending integrated legs with captive stainless steel launch springs, the legs are in alignment and contact with the top of the basket housing when the receiver housing is connected to the housing basket, the captive springs are compressed and under load when the receiver housing is connected to the basket housing and are adapted to provide a launch force for separation of the receiver housing form the basket housing upon activation of the separation means.

7. The maritime floatation device as claimed in claim 6, wherein there are four equally spaced apart downwardly depending integrated legs.

8. The maritime floatation device as claimed in claim 1, wherein the separation means includes a blade assembly having a cutting blade adapted to pass through the receiver housing so as to deactivate the retention means, the blade assembly is housed within the receiver housing and is connected to a separation initiation chamber within the receiver housing, the separation initiation chamber includes therein the explosive means to the timed initiated receiver such that upon activation of the timed initiated receiver the explosive means detonates to cause the cutting blade to deactivate the retention means thus causing the ejector arms to be released and the captive springs on the legs to be decompressed forcing the receiver housing to separate from the basket housing, wherein the retention means that releasable retains the two housing together includes an elongate member securable to the elector arms to hold the ejector arms in a clamping position to lugs on the basket housing, the elongate member is adapted to be severed by the cutting blade in order to assist in releasing the ejector arms form the lugs.

9. The maritime floatation device as claimed claim 8, wherein the elongate member is tensioned so as to cause the ejector arms to be securely clamped to the lugs.

10. The maritime floatation device as claimed in claim 9, wherein, the elongate member is a spring loaded lanyard.

11. The maritime floatation device as claimed in claim 1, wherein the receiver housing has a gland plate and a gland on the underside of the receiver housing, the gland plate and gland are adapted to allow the connection of the shock tube from the spool to enter into the receiver housing, the gland plate houses the gland in order to provide strain relief and a water tight seal between the shock tube internal to the receiver housing and the shock tube external to the receiver housing.

12. The maritime floatation device as claimed in claim 1, wherein the receiver housing includes a void or voids for general securing and tethering of the maritime floatation device.

13. The maritime floatation device as claimed in claim 1, wherein the basket housing includes a lid secured to the basket housing by locking cord inserted into a locking channel on the basket housing, the lid includes retaining lugs, a base of the basket housing includes a shackle for use in anchoring or tethering the basket housing to the sea floor or any other underwater feature or device suitable for anchoring or tethering purposes, the base of the basket housing includes a plurality of shock tube retention holes that allow locking of the shock tube in order to provide strain relief.

14. The maritime floatation device as claimed in claim 1, wherein the shock tube is connectable and initiated via either direct from the second receiver able to initiate the shock tube or from the second receiver able to initiate electric detonators.

15. The maritime floatation device as claimed in claim 1, wherein the electric to the shock tube connection includes a mechanical fixing means to allow reliable initiation of the shock tube by electric initiation, the mechanical fixing means fixes the placement and location of the shock tube through a retention system so as to retain the shock tube in the vicinity of the electric detonator for reliable initiation under water.

16. The maritime floatation device as claimed in claim 1, wherein the shock tube spool includes a two piece reeling assembly and a clamping means to allow for securing during operation of the spool.

17. The maritime floatation device as claimed in claim 1, wherein the float is a ring or rings that provide buoyancy and enhanced stability for the maritime floatation device.

18. A set up method of maritime floatation device using two shock tube receivers including the steps of:

a) undertaking a pre inspection drill of the maritime floatation device is undertaking, if the maritime floatation device fails the pre inspection drill it is quarantined;
b) preparing the at least two receivers;
c) removing a lid of a receiver housing and selecting top and bottom brackets for receivers and securing a base bracket inside the receiver housing;
d) preparing a length of shock tube of >100 mm and inserting the shock tube in to a separation initiation chamber or electric initiating means within the separation initiation chamber;
e) switching on a timed initiated receiver that is used for the float separation;
f) inserting a remote initiated receiver in to the receiver housing;
g) clamping and securing the receivers firmly into place using the top bracket;
h) inserting the shock tube length in to the timed initiated receiver after BIT test and timer setup are completed or connecting an electric initiating method of separation to a timed initiated receiver after BIT test is completed;
i) inserting a spool into a basket housing;
j) taking an end of the shock tube with a pre-fitted detonator and passing through three shock tube retention holes in the base of the basket housing;
k) adjusting a length of shock tube between the basket housing and detonator;
l) Passing the shock tube through a centre hole of a basket lid;
m) assembling and securing the basket lid to the basket housing using a locking cord and making sure the shock tube is pulled through the centre hole in the basket lid;
n) ensuring a receiver housing gland locking wheel is open;
o) taking a spare end of the shock tube and trimming a running end of shock tube to ensure a dry and square cut as per shock tube manufacturer recommendations prior to insertion into a explosive means of the remote initiated receiver or receivers;
p) taking trimmed cut end of the shock tube fed from the centre of the basket lid internal to the spool and feed into the receiver housing through the gland locking wheel and the gland plate or feeding the spare end of the shock tube into the electric to shock tube initiation capability;
q) turning on the remote initiated receiver by pushing the external push button;
r) inserting the shock tube in to the receiver after BIT test is completed;
s) orientating and adding the floats on the receiver housing;
t) checking an o-ring used for creating a seal for the housing lid;
u) orientating the lid to fit to the receiver housing using locking cord;
v) closing the gland locking wheel on the receiver housing base to provide a watertight seal;
w) assembling a retaining lanyard to the receiver housing such that ejector arms move freely but retain tension keeping the ejector arms in a closed clamping position;
x) feeding any excess shock tube on to the spool;
y) orientating and positioning captive sprung legs with respective holes in the basket housing lid; and
z) pushing down the receiver housing onto the basket housing so as to secure the receiver housing to the basket housing such that maritime floatation device is ready for deployment.

19. The set up method of maritime floatation device as claimed in claim 18, wherein the method includes the steps of using at least one shock tube receiver and at least one electric receiver.

20. The set up method of maritime floatation device as claimed in claim 18, wherein the method includes the step of using two electric receivers.

* * * * *